US006757922B2

(12) United States Patent
Chancey

(10) Patent No.: US 6,757,922 B2
(45) Date of Patent: Jul. 6, 2004

(54) BIFURCATED WRAP-AROUND COVERING

(76) Inventor: Roslyn Judith Chancey, PMB 793, 120 E. Oakland Park Blvd. #105, Ft. Lauderdale, FL (US) 33334

( * ) Notice: Subject to any disclaimer, the term of this patent is extended or adjusted under 35 U.S.C. 154(b) by 0 days.

(21) Appl. No.: 09/951,309

(22) Filed: Sep. 11, 2001

(65) Prior Publication Data

US 2003/0046763 A1 Mar. 13, 2003

(51) Int. Cl.[7] ..... A41D 3/00
(52) U.S. Cl. ..... 5/482; 5/655; 2/69.5
(58) Field of Search ..... 5/482, 494, 496, 5/655; 2/69, 69.5

(56) References Cited

U.S. PATENT DOCUMENTS 3,034,132 A * 5/1962 Landsberger et al. ..... 2/69.5
3,477,065 A * 11/1969 Hoover ..... 2/69.5
4,745,634 A * 5/1988 Douez ..... 2/69
4,897,885 A * 2/1990 Lunt ..... 2/69.5
5,023,952 A * 6/1991 Palmer ..... 2/69
5,046,204 A * 9/1991 Mohler ..... 2/69
5,611,095 A * 3/1997 Schneider ..... 2/69
5,852,827 A * 12/1998 Lear ..... 5/482
5,887,301 A * 3/1999 Anderson ..... 5/482
5,897,164 A 4/1999 Kagan et al. ..... 297/219.12
5,956,766 A * 9/1999 Benway ..... 2/69
6,003,749 A * 12/1999 Sabo ..... 2/69.5
6,009,576 A * 1/2000 Gramme et al. ..... 2/69
6,029,274 A * 2/2000 Welchel et al. ..... 2/69
6,389,597 B1 * 5/2002 Henegan ..... 2/69.5
6,415,442 B1 * 7/2002 Smith ..... 2/69.5

* cited by examiner

*Primary Examiner*—Thomas B. Will
*Assistant Examiner*—Tara L. Mayo

(57) ABSTRACT

A bifurcated wrap-around covering which covers an already seated person, infant to adult. The covering is made to straddle a vertical obstruction in the crotch area 54 of a child's seating structure and made to wrap a child's legs into leg compartments 57 and 57A. Significant is the cut of the top edges of the rear leg compartment panels 56 and 56A that surround a user's buttocks 84 wherein a user's buttocks is exposed, allowing the covering to be placed without the necessity of lifting a user, nor lifting a user's legs. Additional material allows the invention to become a body wrap. The covering in larger sizes wraps the legs of larger persons and can be used as a blanket, or with ties at the waistline, a slacks garment for invalids and handicapped persons in wheelchairs.

13 Claims, 51 Drawing Sheets

BIFURCATED WRAP-AROUND COVERING

BACKGROUND

1. Field of Invention

This invention is in the field of wraps and blankets specifically for covering a small child when seated in a structure with an obstruction in the crotch area, and blankets and garments for invalids and handicapped persons.

2. Description of Prior Art Young children, particularly infants, are often placed in seating structures of the type having an obstruction which projects upward between the legs of the child. These obstructions primarily serve as a safety function of helping to restrain the child in the device. Said structures include but are not limited to hi-chairs, car seats, baby swings, bounce seats, carriers and strollers.

Ordinary flat blankets are not very effective for use on a child seated in these types of structures because it is difficult to fit an ordinary flat blanket around an obstruction that is in the crotch area. Typically, an ordinary flat blanket has to be bunched up and stuffed around the post in an effort to cover as many parts of the child as possible. However, it is not uncommon for some parts of the child to be uncovered with this approach. Additionally, bunching leaves gaps between the blanket and the structure through which cool air can reach the child. Further, bunched-up blankets fall out of position easily, uncovering the child.

Many structures seat the child in such a way that only a child's buttocks and upper thighs touch the seat, leaving the lower thighs and lower legs exposed to cold air. An ordinary flat blanket cannot, and is not, intended to cover the back sides of a child's legs. Kagan U.S. Pat. No. 5,897,164, Apr. 27, 1999, 297/219.12 created a blanket specifically to be used on a child seated where there is an obstruction in the crotch area. Kagan's invention is in agreement with my bifurcated wrap-around covering in that it offers leg receiving pockets. However, Kagan does not satisfy the need to cover and protect the entire leg. kagan's pockets only hold the foot and the calf, with the remaining rear leg unprotected. Constructed as shown in FIG. 17 of kagan's invention, Kagan's pockets cannot be lengthened to protect the upper leg area. Lengthening would render Kagan's invention useless for this reason: Once one leg were to be inserted, and the other leg compartment brought behind the obstruction, the opening at the top of the second leg compartment could not be brought down far enough to reach the second foot.

Another undesirable facet of Kagan's invention is the connecting of the leg compartments. Connecting the leg compartments restricts leg movement. All 51 claims of Kagan's invention teach to connect the two lower bifurcated blanket sections, involving a fastening means. Failure to connect the two lower sections results in the blanket drooping down, and drooping down with it is the shallow leg pocket, exposing the foot and calf.

The invention of Schneider U.S. Pat. No. 5,611,095, Dec. 12, 1995, 5/482, appears to be close prior art. However it is not a covering blanket; it is a multi-function baby wrap. One is instructed to place the child's back onto the blanket, wherein one can proceed to wrap the child. With the blanket already on the child, the child would then be placed into a seat. It would be difficult to place Schneider's blanket onto a child who was already seated. The child would have to be lifted, and much fumbling would have to take place to flatten the blanket beneath the child's buttocks, and to be able to fasten the leg compartments.

What is needed in the art is a blanket that covers the back side of a child's legs, which blanket can be placed on a child already seated in a structure where there is a crotch obstruction. This blanket should cover both a child's torso and all the exposed areas of a child's legs. Further, being that many children are already sleeping when the climate changes, such a blanket should be constructed in such a manner that when the blanket is placed on a child, or removed from a child, that it can be done without waking the child.

There is a similar problem in covering seated invalids and handicapped persons of all ages. The prior art offers only flat blankets which do not address the problem of covering a person's legs properly, being that the back area of a person's legs are exposed when laying a blanket over a person in a wheelchair.

Further needed in the art is a covering blanket that can be placed on an invalid or handicapped person that covers the back side of a user's legs, without the user having to be lifted. Most ideally would be such a blanket that a user who has use of his arms, can place on himself.

In the field of invalids' and handicapped-persons' garments, the prior art does not offer slacks specially constructed to be placed on a user already seated. While the invention of Grassic U.S. Pat. No. 4,914,756, Apr. 10, 1990 is an article of clothing for the handicapped, it would be extremely difficult for a handicapped person to place this garment on himself, especially if paralyzed in the lower extremities and already seated.

What is needed in the art is a covering garment that includes slacks that can easily be placed on a user already seated wherein neither the user nor the user's legs need to be lifted.

Most ideally would be a slacks garment that's stylish, either made as a separate clothing item, or part of a multi-piece outfit, or a one-piece garment of slacks with attached torso covering, wherein a user who has use of his arms can dress himself. Toileting would be easier if an invalid or handicapped person were able to dress in this type of garment.

Objects and Advantages

Several Objects of my Invention are (a) to provide a bifurcated wrap-around covering blanket for a child seated in a structure having a crotch obstruction, which covering blanket surrounds and protects both legs entirely.

(b) to provide a bifurcated wrap-around covering blanket that can be applied and removed quickly without having to lift a user nor a user's legs.

(c) to provide a bifurcated wrap-around covering blanket for persons seated in wheelchairs, wherein the blanket covers both the front and back of a user's legs.

(d) to provide a bifurcated wrap-around covering product that has versatility, that can be used for a covering blanket and also a wrap.

(e) to provide a bifurcated wrap-around covering garment that includes slacks for invalids and handicapped persons, wherein the slacks can be placed onto the user easily while the user is seated.

(f) to provide a bifurcated wrap-around covering blanket for invalids and handicapped persons who, if they have use of their arms, can themselves cover the back of their legs as well as the front.

(g) to provide a bifurcated wrap-around covering garment that includes slacks for invalids and handicapped persons who, if they have use of their arms, can independently dress themselves while seated in a wheelchair.

(h) to provide a bifurcated wrap-around covering garment, specifically slacks for invalids and handicapped persons who, if they have use of their arms can independently undress themselves when toileting and independently dress themselves after toileting.

(i) to provide a bifurcated wrap-around covering product that is machine washable and dryable.

(j) to provide a bifurcated wrap-around covering blanket, wrap and garment that require simple sewing, that a novice can make.

Several Advantages of my Bifurcated Wrap-around Covering are That (a) my bifurcated wrap-around covering solves the problem of shallow pockets from which a user's foot comes out, as seen in the invention of Kagan 5,897,164. My covering solves this problem by wrapping the legs instead of inserting them.

(b) the leg compartments of my bifurcated wrap-around covering, unlike Kagan's invention, are separate from one another, allowing freedom of leg movement.

(c) the leg compartments of my bifurcated wrap-around covering are wide, allowing a child to be able to flex his legs within the compartment without restriction, and to be lifted out from the compartments easily.

(d) the circular cut of the rear leg compartment panels surrounds the buttocks, allowing easy placement of my bifurcated wrap-around covering.

(e) my bifurcated wrap-around covering can be placed onto a user, and the user's legs can be wrapped without having to lift a user nor a user's legs.

(f) my bifurcated wrap-around covering is versatile in that it can be combined to be a covering blanket and a wrap.

(g) my bifurcated wrap-around covering is useful for persons of all ages.

(h) my bifurcated wrap-around covering solves the problem of being able to cover, without waking, a child who is already asleep seated in a structure having an obstruction in the crotch area.

(i) with my bifurcated wrap-around covering being used as a covering blanket, invalids and handicapped persons who have use of their arms can place the blanket on themselves while seated in a wheelchair.

(j) as a garment, my bifurcated wrap-around covering allows invalids and handicapped persons who have use of their arms to dress and undress themselves while seated in a wheelchair.

(k) as a garment, my bifurcated wrap-around covering allows invalids and handicapped persons to toilet independently by being able to remove the lower garment.

Other objects and advantages will become apparent from the specification and drawings.

DRAWING FIGURES

Figure 31:
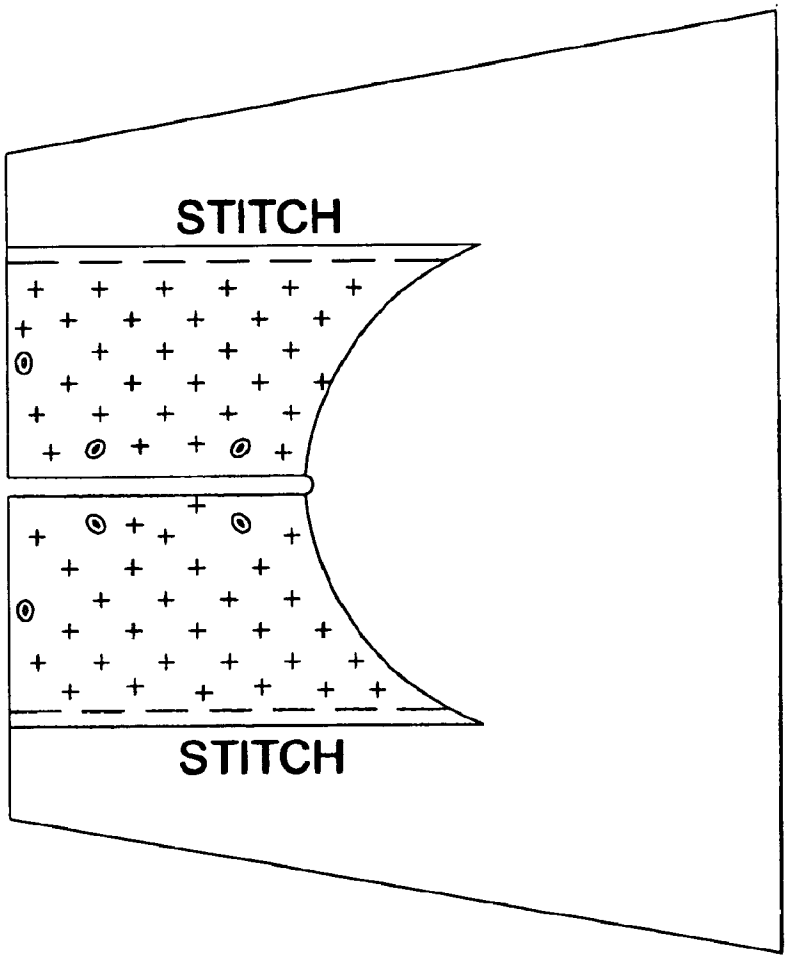

FIG. 31 shows sixth embodiment, a bifurcated wrap-around covering blanket. Leg compartment rear panels have been cut from a separate piece of flexible material. Outside edges of leg compartment rear panels have been sewn to the flexible material.

Figure 32:
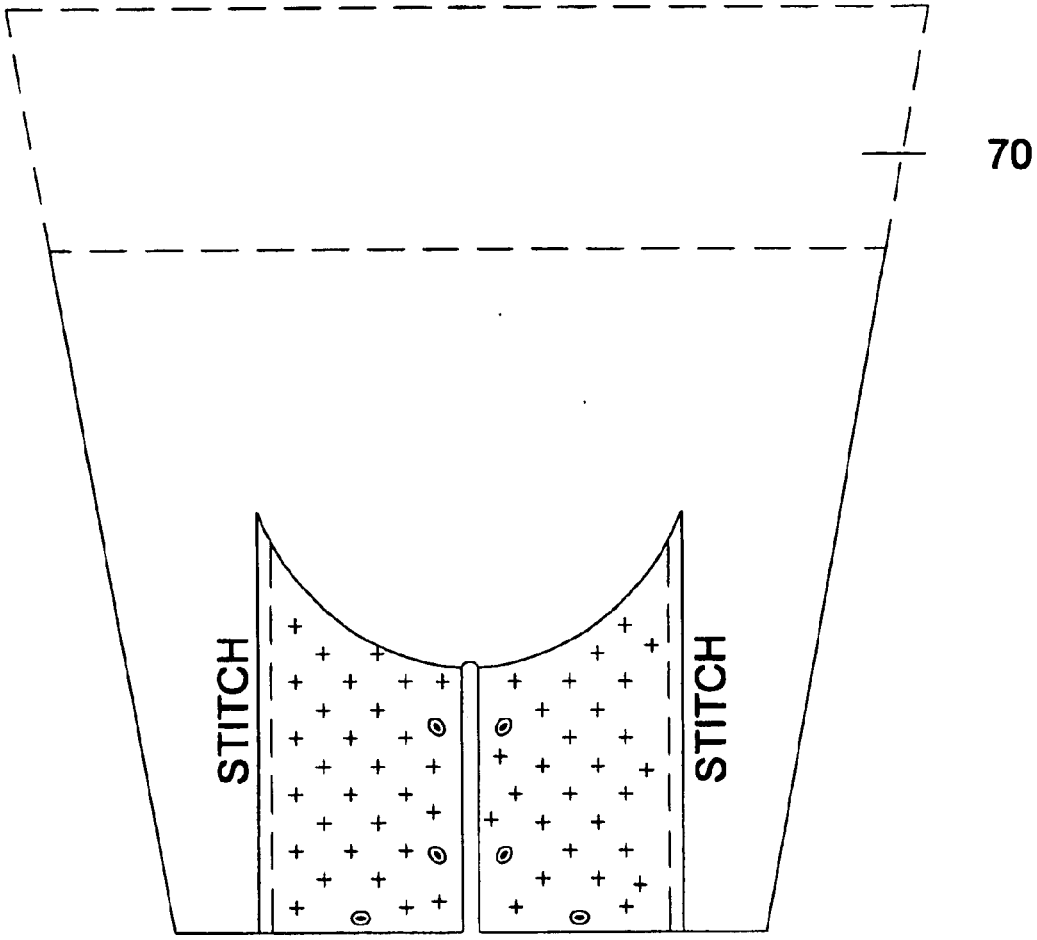

FIG. 32 shows seventh embodiment, combination covering blanket and wrap, with additional flexible material in the longitudinal dimension for a person's head for when used as a wrap.

Figure 33:
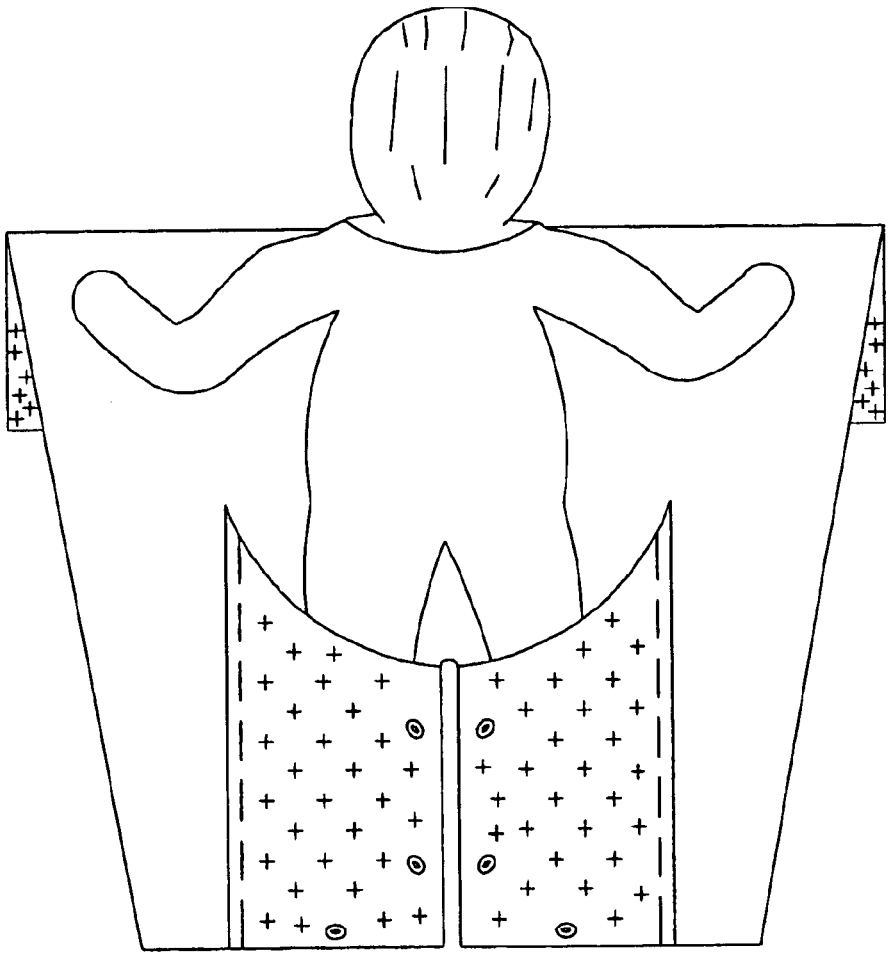

FIG. 33 shows seventh embodiment, combination covering blanket and wrap with additional flexible material in the longitudinal dimension for a person's head for when used as a wrap, shown being used as a covering blanket, rear view.

Figure 34:
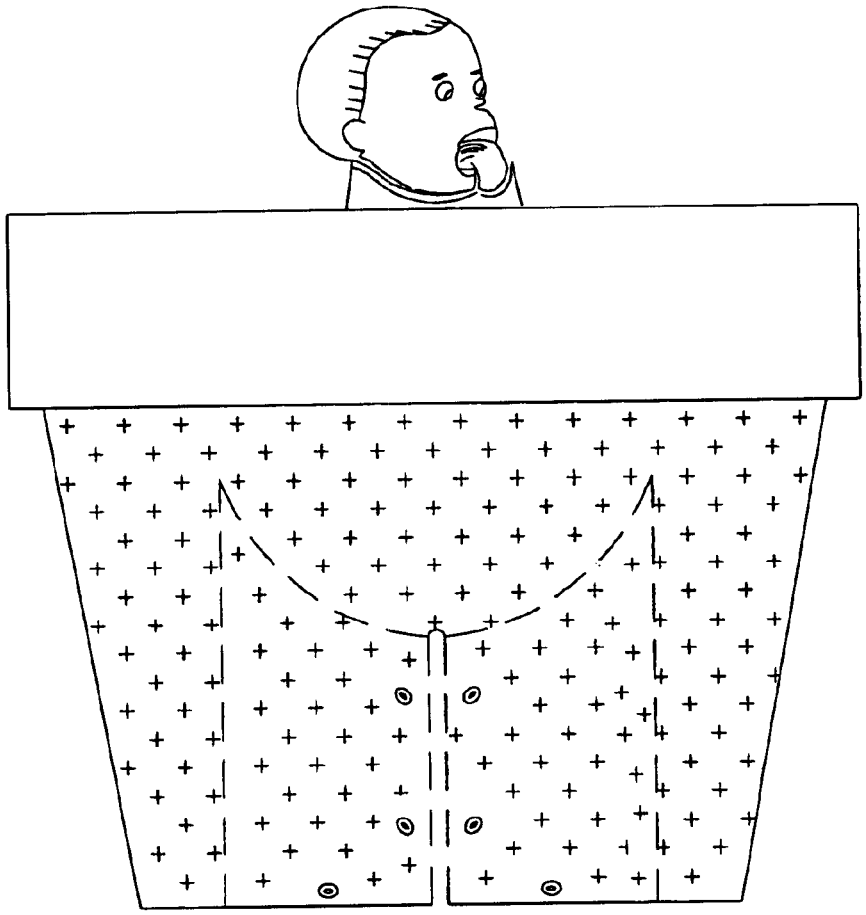

FIG. 34 shows seventh embodiment, combination covering blanket and wrap, with additional flexible material in the longitudinal dimension for a person's head for when used as a wrap, shown being used as a covering blanket, front view.

Figure 35:
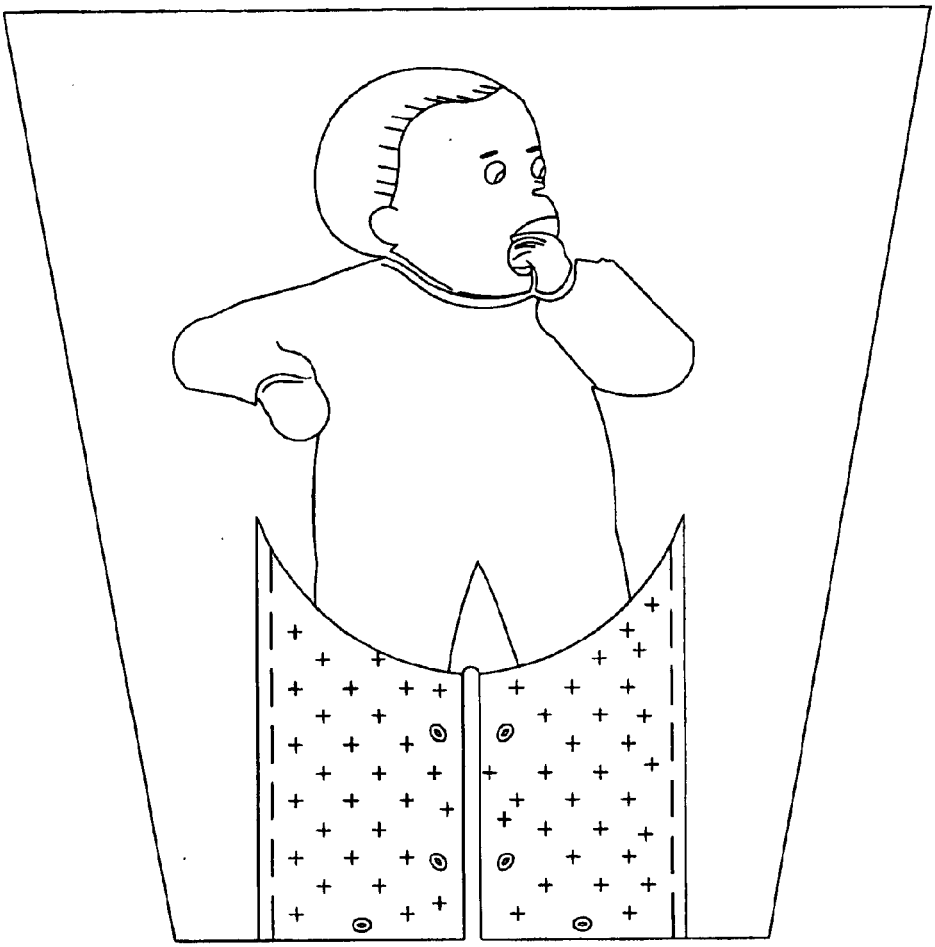

FIG. 35 shows seventh embodiment, combination covering blanket and wrap, with additional flexible material in the longitudinal dimension for a person's head when used as a wrap, shown being used as a wrap.

Figure 36:
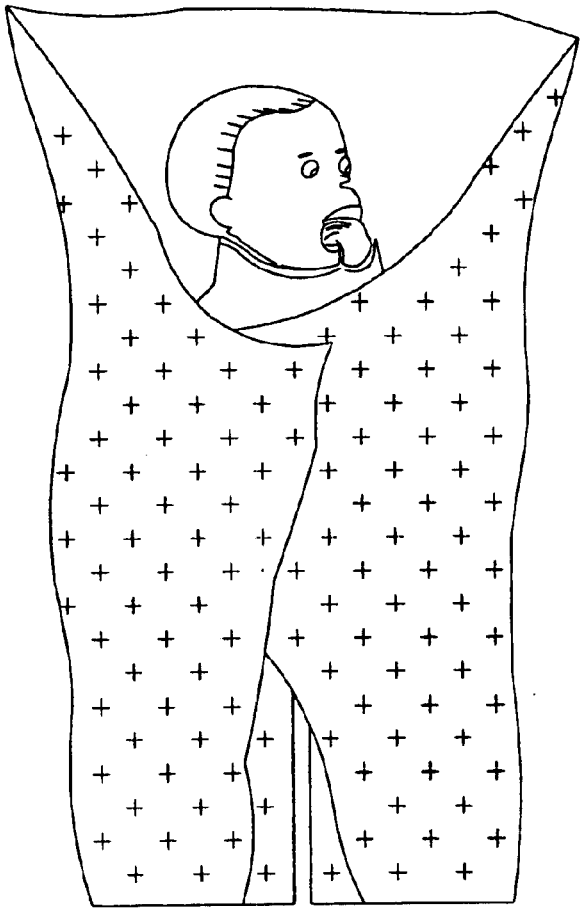

FIG. 36 shows seventh embodiment, combination covering blanket and wrap, with additional flexible material in the longitudinal dimension for a person's head when used as a wrap, with a person wrapped up.

Figure 37:
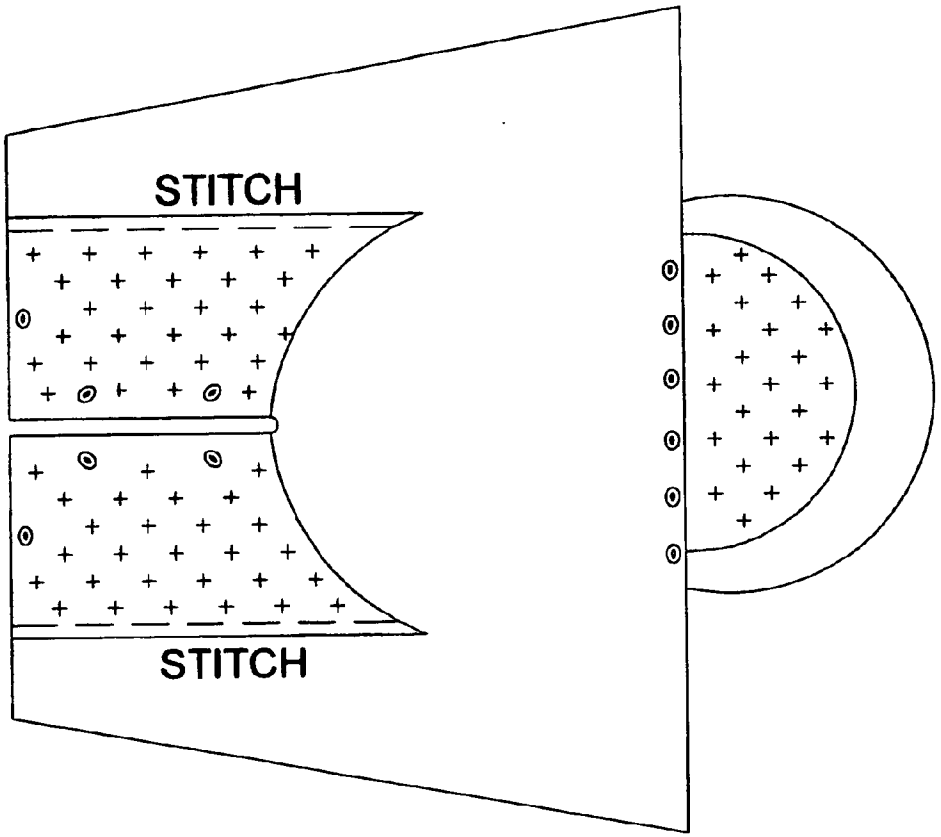
Figure 38:
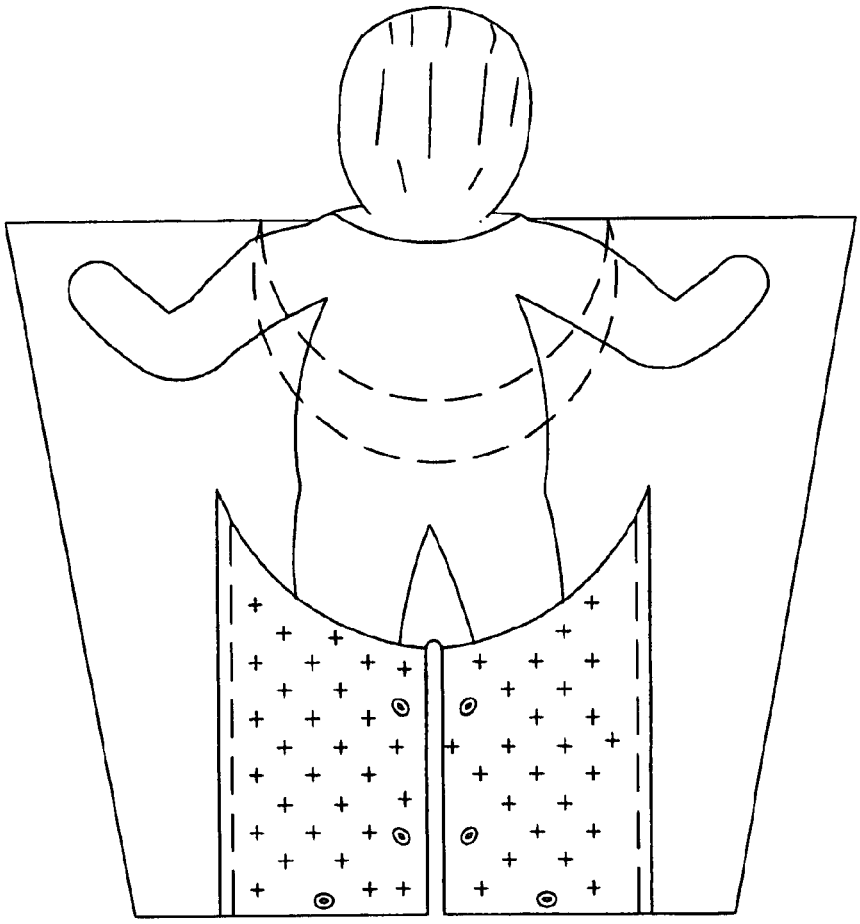

FIG. 37 shows eighth embodiment, combination covering blanket and wrap with removable hood, leg compartments rear panels have been cut from a separate piece of material. Outside edges of leg compartment rear panels have been sewn to the flexible material FIG. 38 shows eighth embodiment, combination covering blanket and wrap with removable hood, shown being used as a covering blanket, rear view.

Figure 39:
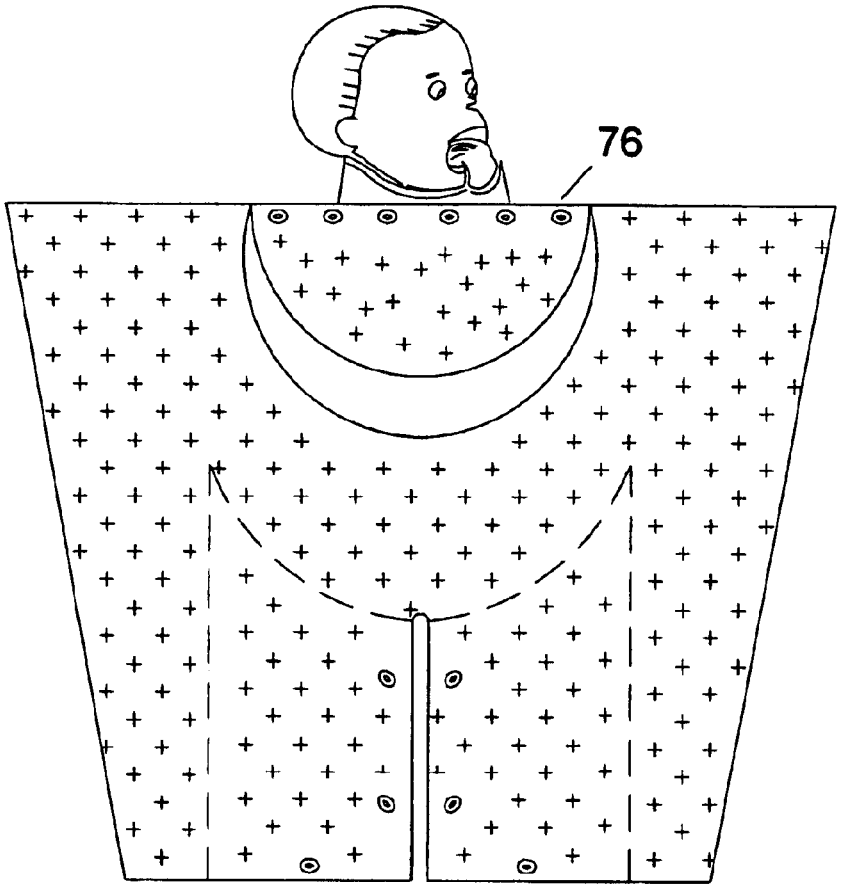

FIG. 39 shows eighth embodiment, combination covering blanket and wrap with removable hood, shown being used as a covering blanket, front view.

Figure 40:
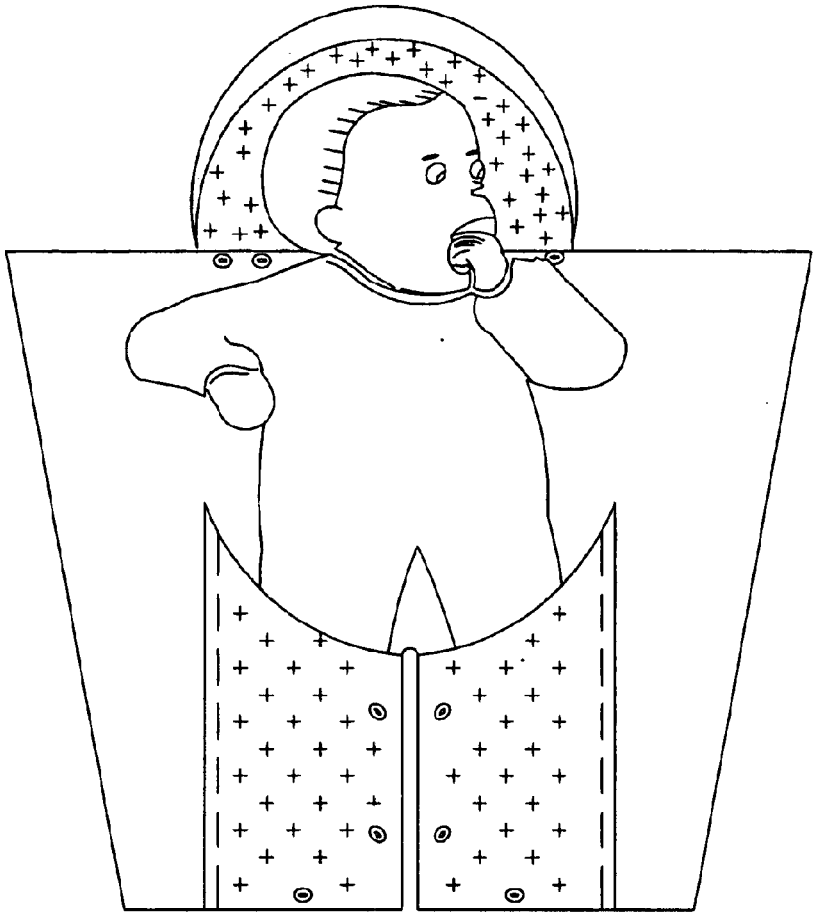

FIG. 40 shows eighth embodiment, combination covering blanket and wrap with removable hood, shown being used as a wrap.

Figure 41:
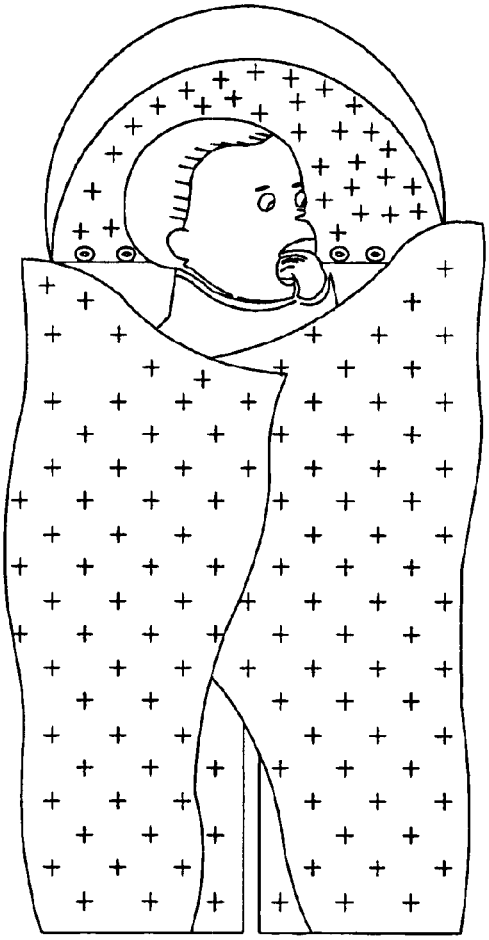

FIG. 41 shows eighth embodiment, combination covering blanket and wrap with removable hood, with a person wrapped up.

Figure 42:
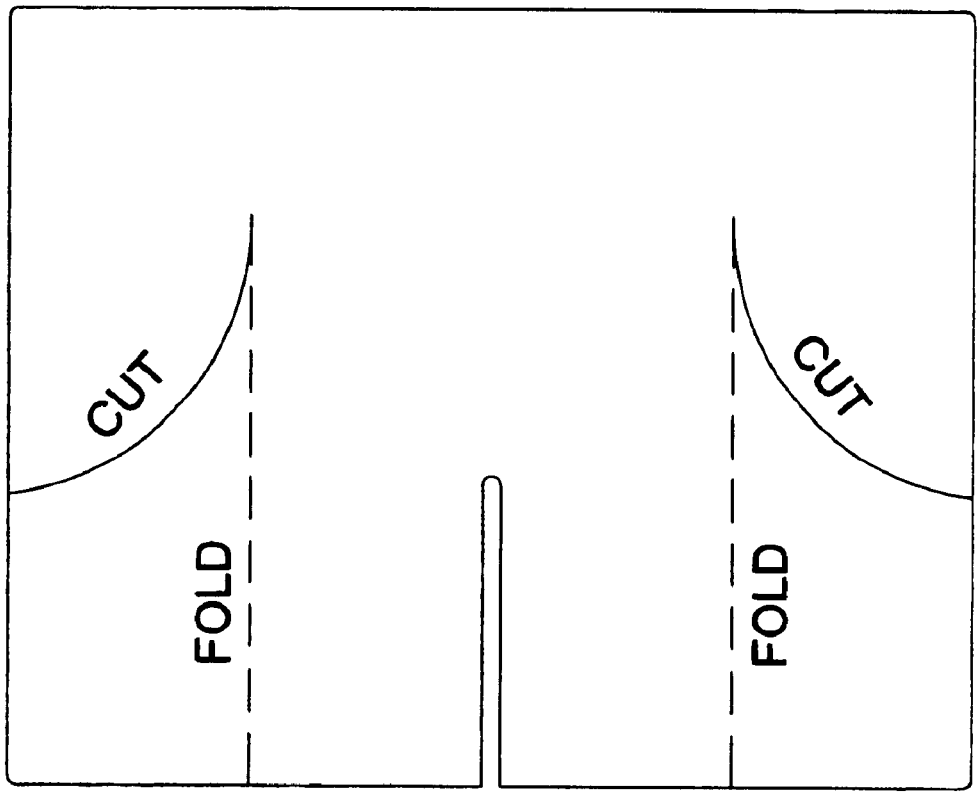

FIG. 42 shows the cuts of the material prepared for a bifurcated wrap-around slacks garment ninth embodiment.

Figure 43:
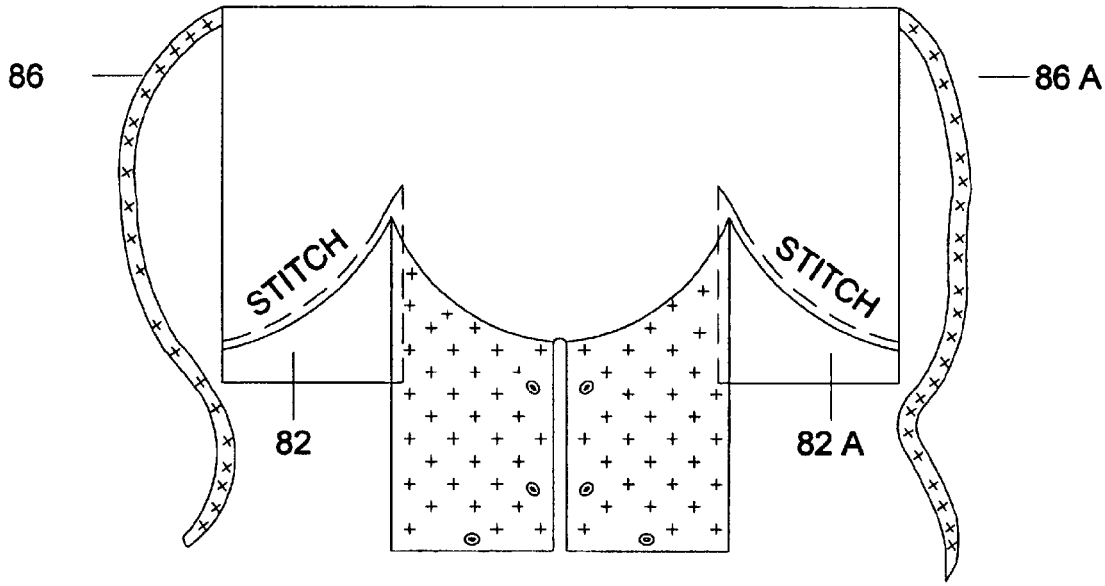

FIG. 43 shows ninth embodiment slacks garment privacy flaps and ties.

Figure 43A:
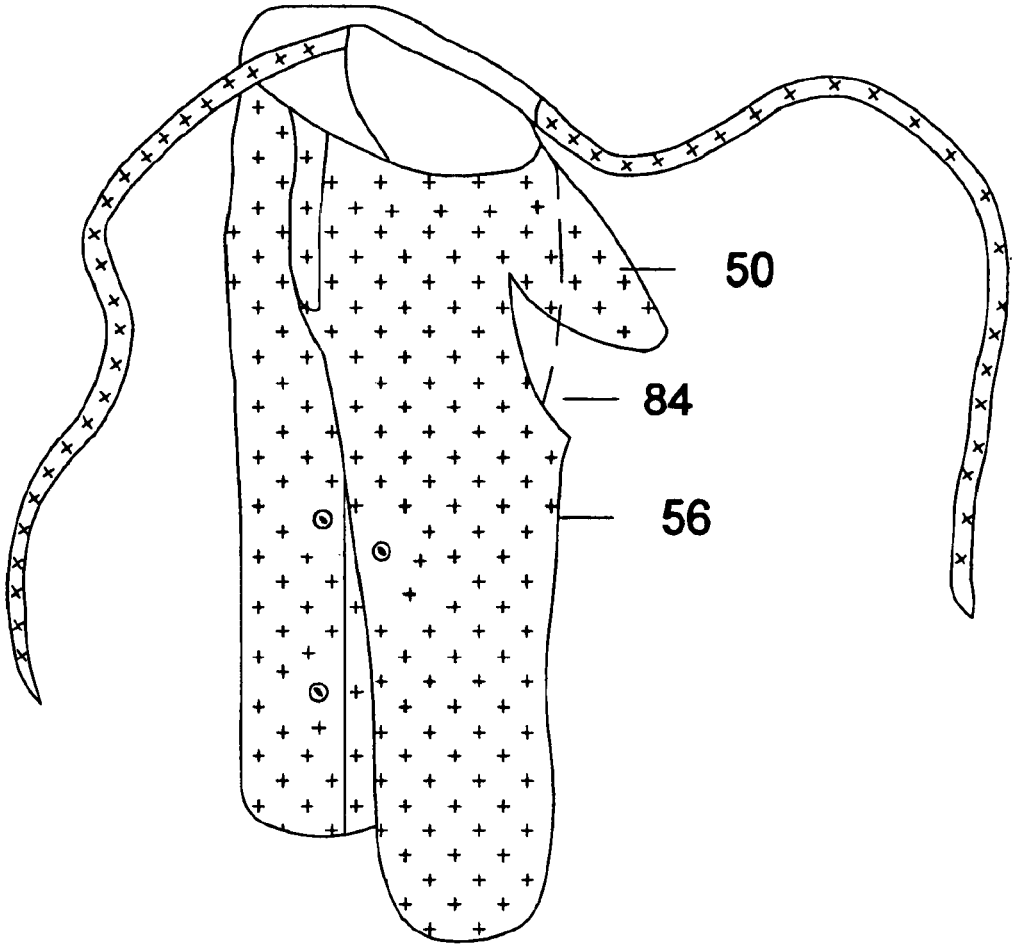

FIG. 43A shows ninth embodiment upper circularly-cut section of material is lifted, shows underwear on a person's buttocks.

Figure 43B:
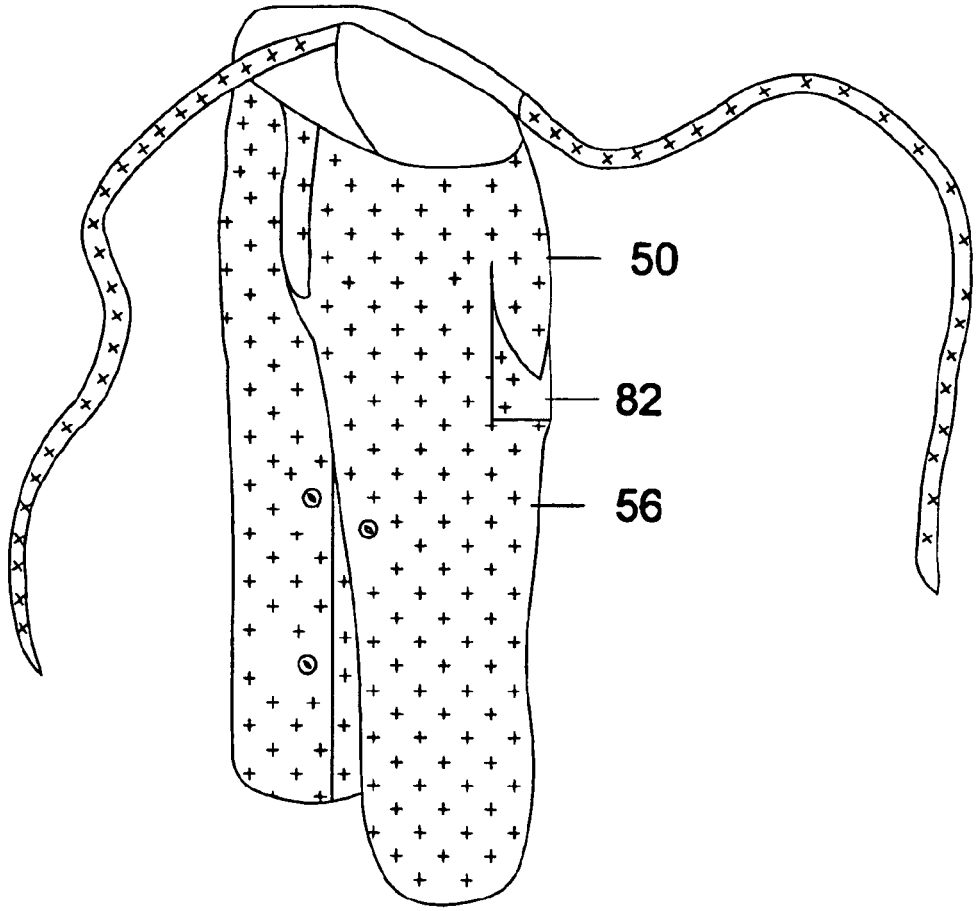

FIG. 43B shows ninth embodiment left leg privacy panel is sewn to material above left rear leg panel.

Figure 44:
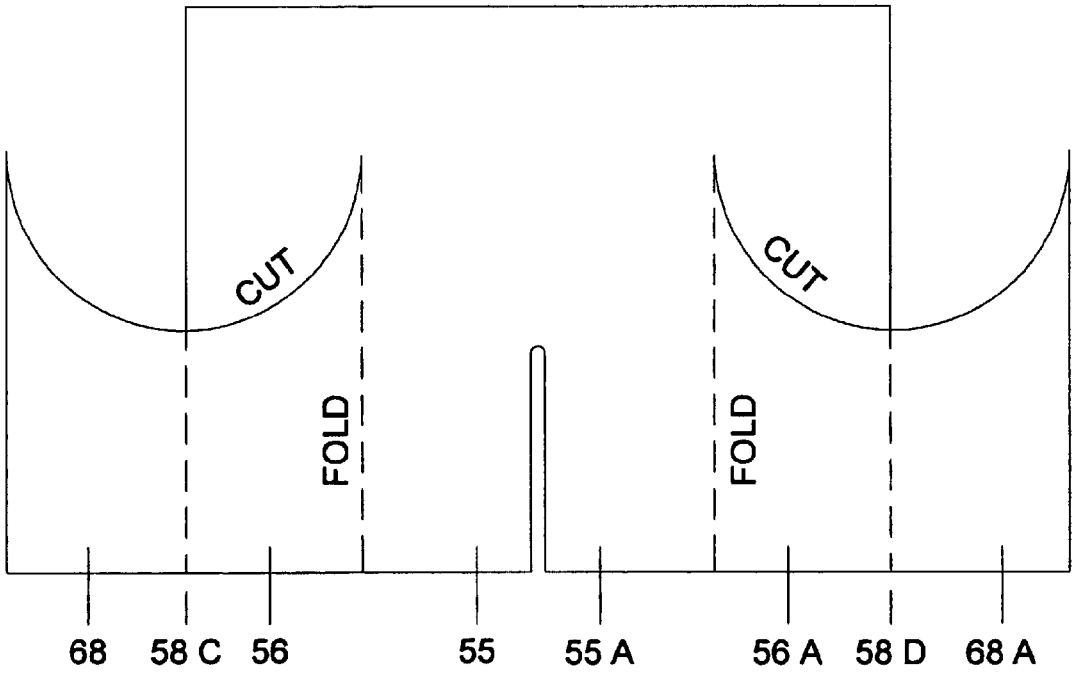

FIG. 44 shows extensions to the rear leg compartment panels adjoining inner segments 3 and 4 which extensions are in actuality, a second set of front leg compartment panels that wrap over the first set of front leg compartment panels in embodiments 10 through 15.

Figure 45:
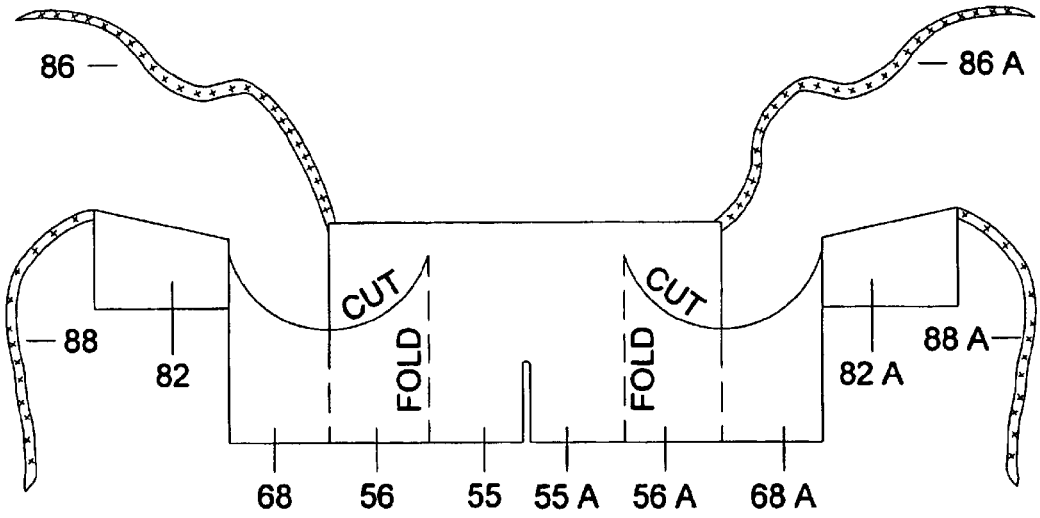

FIG. 45 shows bifurcated wrap-around slacks garment embodiment 15, wherein privacy flaps and ties have been added to the second set of front leg compartment panels.

Figure 46:
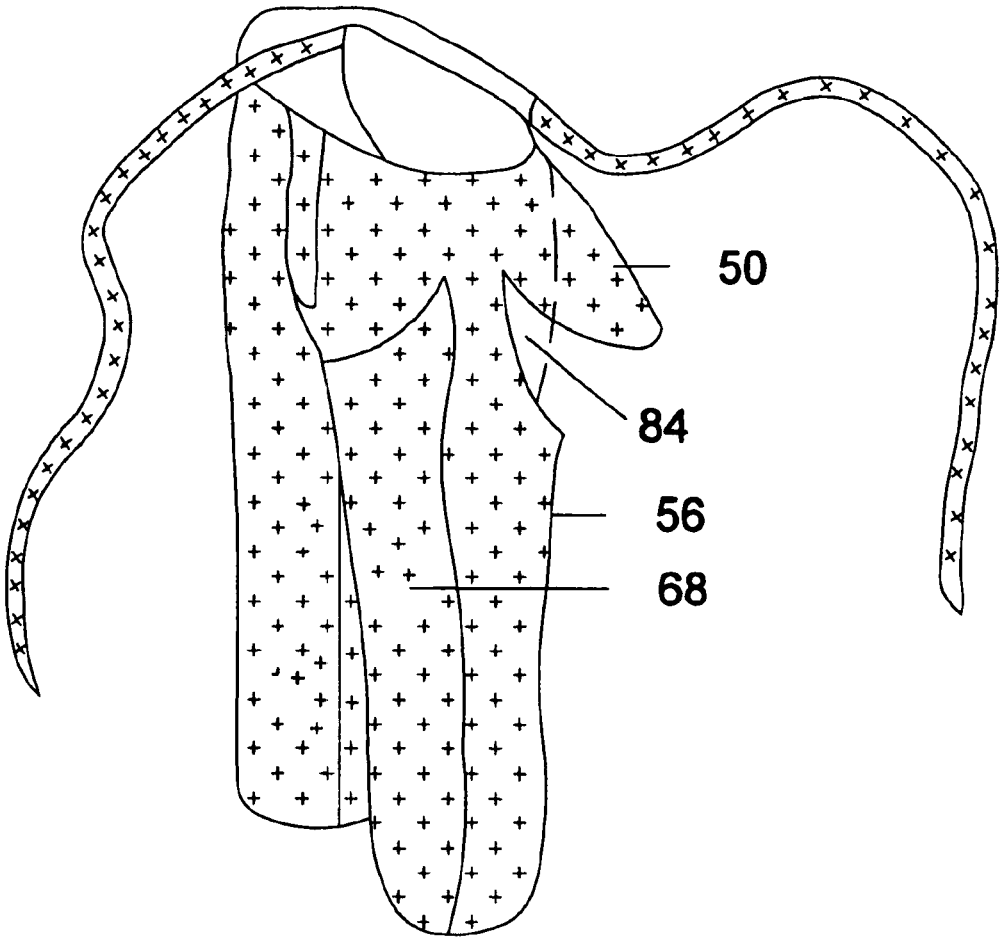

FIG. 46 shows slacks garment embodiment 15, additional front panels are in place. Upper section of material above left rear leg panel is lifted.

Figure 47:
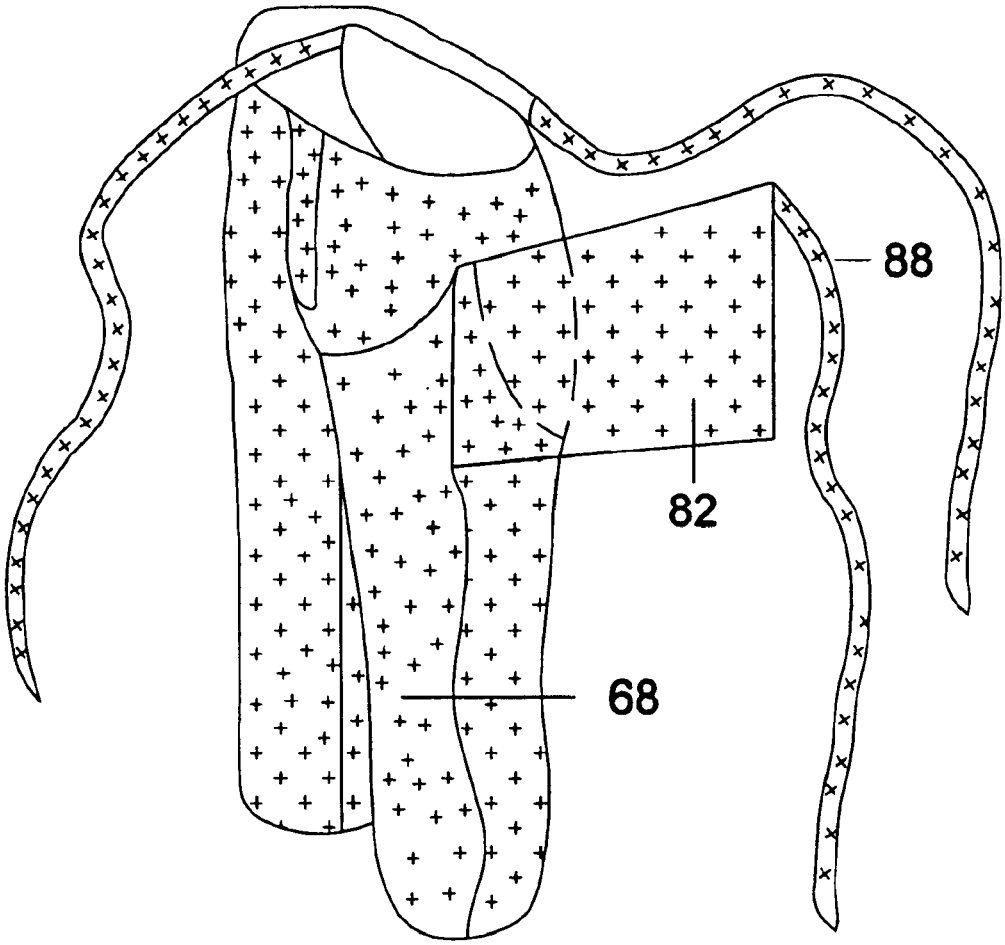

FIG. 47: slacks garment embodiment 15, left leg privacy panel shown attached to second front panel of left leg compartment.

Figure 48:
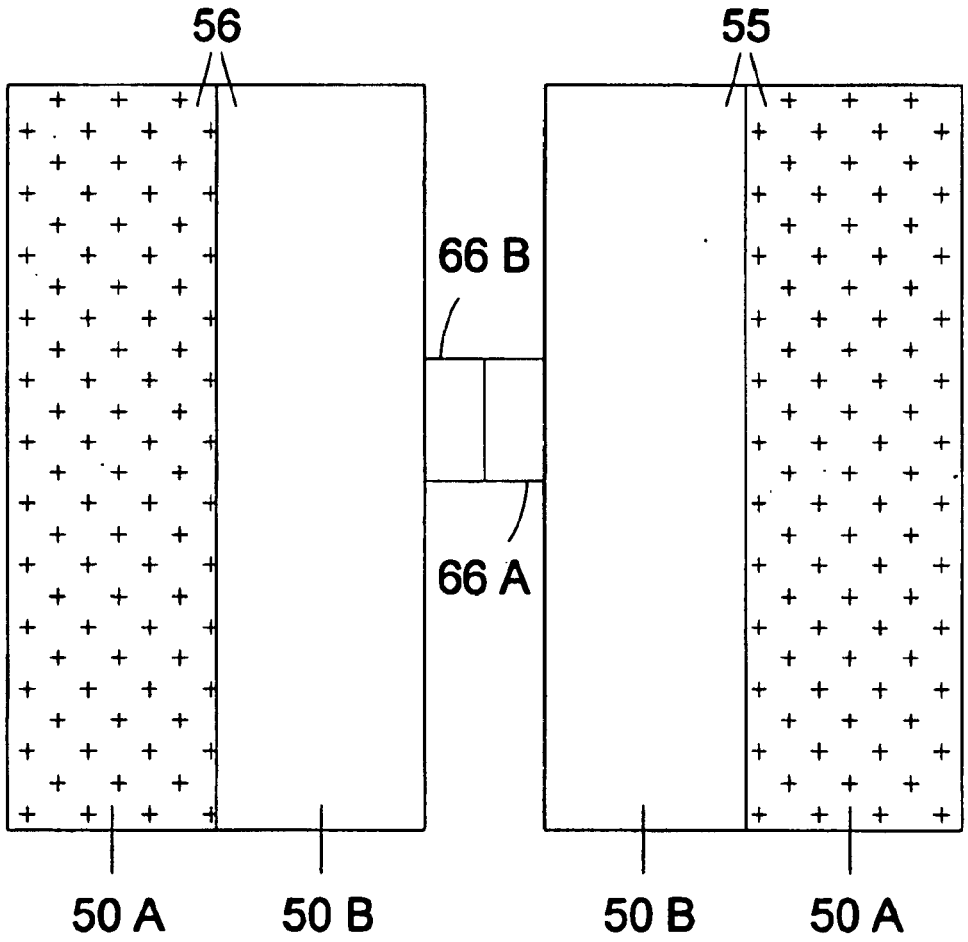

FIG. 48: shows from aperture edge, view through inner segment 1 and inner segment 3 showing male and females fastening snaps engaged.

REFERENCE NUMERALS IN DRAWINGS

50—FLEXIBLE MATERIAL
50A—FRONT SIDE OF FLEXIBLE MATERIAL
50B—BACK SIDE OF FLEXIBLE MATERIAL
50C—EDGE
50D—FIRST UPPER OUTER SEGMENT
50E—SECOND UPPER OUTER SEGMENT
50F—UPPER SEGMENT
50G—FIRST LOWER SEGMENT
50H—SECOND LOWER SEGMENT
50I—THIRD LOWER SEGMENT
50J—FOURTH LOWER SEGMENT
50K—FIRST LOWER OUTER SEGMENT
50L—SECOND LOWER OUTER SEGMENT
52—APERTURE
54—CROTCH AREA
55—LEFT FRONT LEG COMPARTMENT PANEL
55A—RIGHT FRONT LEG COMPARTMENT PANEL
56—LEFT REAR LEG COMPARTMENT PANEL
56A—RIGHT REAR LEG COMPARTMENT PANEL
57—LEFT LEG COMPARTMENT
57A—RIGHT LEG COMPARTMENT
58—APEX OF THE APERTURE
58A—FIRST INNER SEGMENT
58B—SECOND INNER SEGMENT
58C—THIRD INNER SEGMENT
58D—FOURTH INNER SEGMENT
59—180 DEGREES MARK LEFT LEG COMPARTMENT
59A—180 DEGREES MARK RIGHT LEG COMPARTMENT
60—90 DEGREES
60A—270 DEGREES
64—TOP EDGE OF LEFT REAR LEG COMPARTMENT PANEL
64A—TOP EDGE OF RIGHT REAR LEG COMPARTMENT PANEL
66—FASTENING MEANS
66A—MALE FASTENERS
66B—FEMALE FASTENERS
68—SECOND LEFT FRONT LEG COMPARTMENT PANEL
68A—SECOND RIGHT FRONT LEG COMPARTMENT PANEL
70—ADDITIONAL FLEXIBLE MATERIAL IN THE LONGITUDINAL DIMENSION FOR HEAD
72—LEFT ADDITIONAL FLEXIBLE MATERIAL IN THE WIDTH

72A—RIGHT ADDITIONAL FLEXIBLE MATERIAL IN THE WIDTH
74—LEFT WING
74A—RIGHT WING
76—REMOVABLE HOOD
82—LEFT PRIVACY FLAP
82A—RIGHT PRIVACY FLAP
84—UNDERWEAR ON BUTTOCKS
86—LEFT TIE UPPER CORNER OF GARMENT
86A—RIGHT TIE UPPER CORNER OF GARMENT
88—LEFT TIE ON PRIVACY FLAP
88A—RIGHT TIE ON PRIVACY FLAP

Summary

A bifurcated covering to be used as a blanket, wrap or garment. Covering covers a user's torso, and wraping a user's legs into leg compartments. The top edges of the rear leg compartment panels surround a user's buttocks and a user's buttocks is exposed, allowing a user's legs to be wrapped when a user is in a seated position. Covering can straddle a vertical obstruction in a seat's crotch area commonly seen in various children's seating structures.

Description

Figure 1:
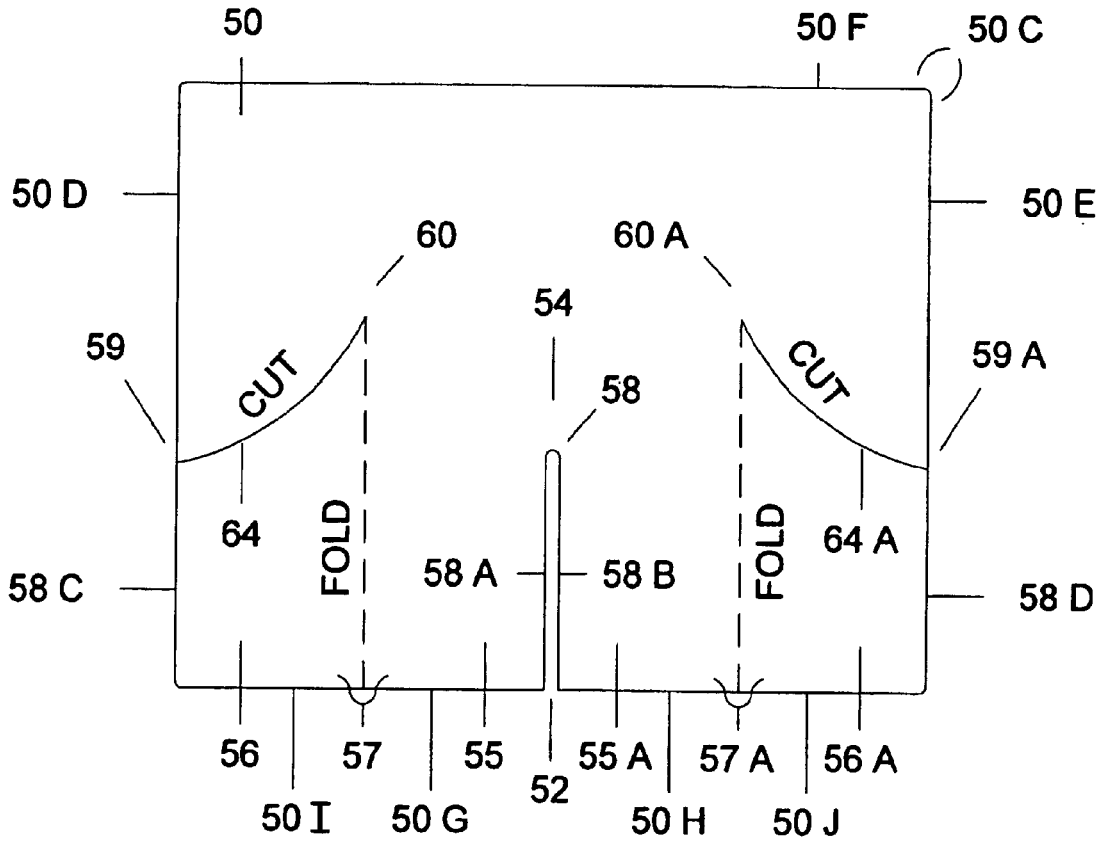
FIG. 1 shows the layout of the flexible material rear view, and where to cut and fold to create the rear leg compartment panels.

A bifurcated wrap-around covering, comprising:

(a) an upper section having
  (1) upper segment 50F,
  (2) a left upper outer segment 50D
  (3) a right upper outer segment 50E (b) a lower section comprising:
  (1) a lower torso covering
  (2) two leg compartments comprising:
    (2*a*) first and second lower outer segments 50K and 50L
    (2*b*) lower segments, 50G, 50H, 50I, and 50J,
    (2*c*) an aperture 52 between upper segment 50F and lower segments, which aperture separates lower segments 50G and 50H
    (2*d*) an apex 58 at the tip of the aperture one-third to one-half the distance from lower segments 50G and 50H to upper segment 50F measuring from lower segments upward toward upper segment.
    (2*e*) inner segments, 58A, 58B, 58C, 58D along the aperture which separates two leg compartments wherein the area above the first and third lower segments 50G and 50I to the left of said aperture comprises both the front and rear left leg compartment panels 55 and 56 thereby forming the left leg compartment 57, and whereby the area above the second and fourth lower segments 50H and 503 to the right of said aperture comprises both the front and rear right leg compartment panels 55A and 56A thereby forming the right leg compartment 57A, and whereby the leg compartments are formed by wrapping each leg, having a plurality of temporary fastening means 66 permanently affixed to the flexible material to disengage or engage said fastening means to secure each leg compartment in a closed position, further described:

As may be seen in FIG. 1, in the preferred embodiment, the invention is comprised of:

(a) flexible material 50 which may be of any fabric suitable for blankets and garments, having
  (1) a front side 50A,
  (2) back side 50B, and
  (3) an edge 50C, comprising
    (3*a*) first and second upper outer segments 50D and 50E, generally parallel to each other,
    (3*b*) upper segment 50F,
    (3*c*) first lower segment 50G extending from first inner segment 58A and located at the bottom of left front leg compartment panel 55, and
    (3*d*) second lower segment 50H extending from second inner segment 58B and located at the bottom of right front leg compartment panel 55A, and
    (3*e*) third lower segment 501 extending from third inner segment 58C and located at the bottom of left rear leg compartment panel 56, and
    (3*f*) fourth lower segment 50J extending from fourth inner segment 58D and located at the bottom of right rear leg compartment panel 56A, (b) first and second lower outer segments 50K and 50L at the outside edges of closed leg compartments 57 and 57A (c) an apex 58 located the a centerline established at halfway between the first and second upper outer segments 50D and 50E and located between upper segment 50F and lower segments: 50G, H, I and J at a point approximately one half to two thirds distance from upper segment 50F, and further located between the first lower segment 50G and the second lower segment 50H, and (d) an aperture 52 which extends from said apex, to and separating the first and second lower segments 50G and 50H, and which aperture separates the left front leg compartment panel 55 from the right front leg compartment panel 55A, and which aperture comprises
  (1) a first inner segment 58A extending from the first lower segment 50G to the apex 58, and
  (2) a second inner segment 58B extending from the second lower segment 50H to the apex,
  (3) a third inner segment 58C extending from the third lower segment 50I to the top edge of the left rear leg compartment panel 64,
  (4) a fourth inner segment 58D extending from the fourth lower segment 50J to the top edge of the right rear leg compartment panel 64A.

A circular cut in material 50 creates left rear leg compartment panel 56 and establishes the top edge of the left rear leg compartment panel 64, upper outer segment 50D and third inner segment 58C. The cut is started at the left edge of material 50 at approximately the same point in distance measured from third lower segment 501 to apex 58 which is the 180 degrees mark 59, which cut extends circularly inward to the right approximately halfway to apex 58 to a point approximately 90 degrees 60, and another circular cut in material creates right rear leg compartment panel 56A and establishes the top edge of the right rear leg compartment panel 64A, upper outer segment 50E and fourth inner segment 58D. The cut is started at the right edge of material 50 at approximately the same point in distance measured from fourth lower segment 50J to apex 58 which is the 180 degrees mark 59A, which cut extends circularly inward to the left approximately halfway to apex 58 to a point approximately 270 degrees 60A.

Figure 2:
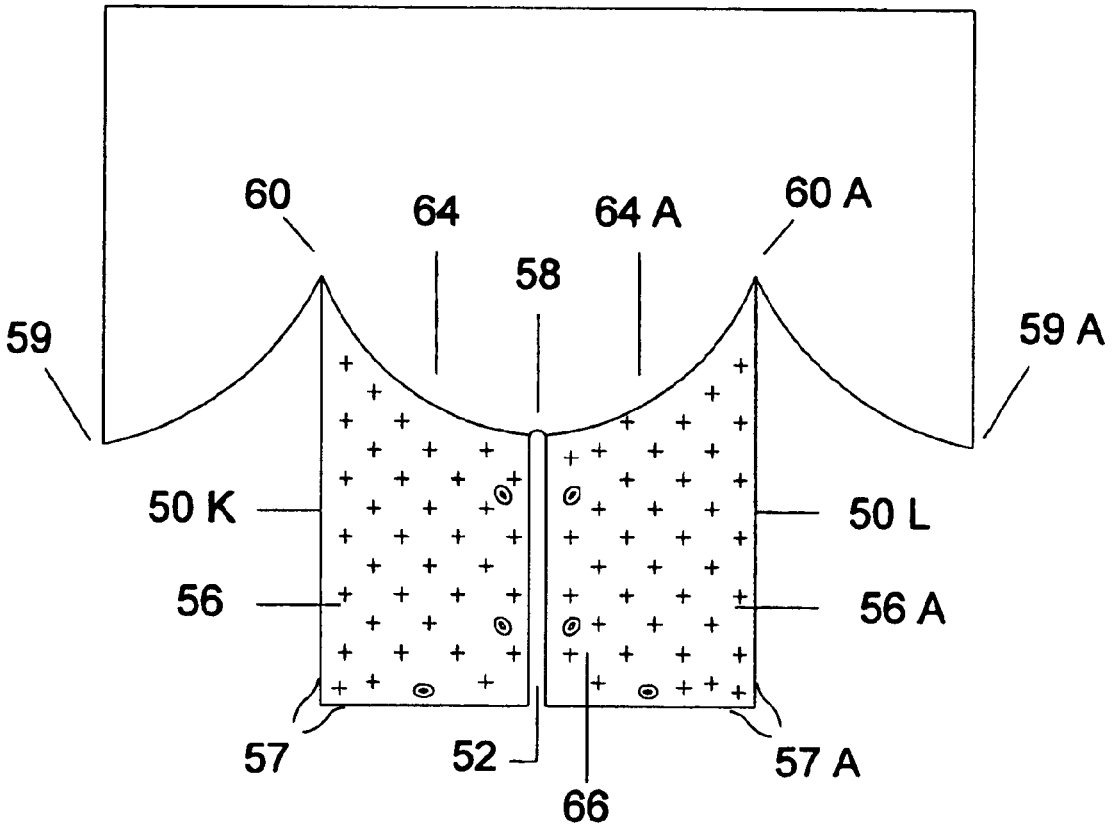
FIG. 2 shows rear leg compartment panels flipped over and in place, the cut that surrounds a user's buttocks, and fastening means along the edges of the aperture inner segments 1,2,3 and 4, and the bottoms of the leg compartments.

As may be seen in FIG. 2 a plurality of temporary fastening means 66 are each comprised of first part male fasteners 66A, and second part female fasteners 66B, whereby (a) male fasteners 66A are permanently affixed to inner segment 58A of the left front leg compartment panel 55 and (b) female fasteners 66B are permanently affixed to inner segment 58C of the left rear leg compartment panel 56 wherein first part male fasteners 66A and second part female fasteners 66B engage each other to provide temporary fastening of left front leg compartment panel 55 to left rear leg compartment panel 56, and (c) male fasteners 66A are permanently affixed to inner segment 58B of the right front leg compartment panel 55A and (d) female fasteners 66B are permanently affixed to inner segment 58D of the right rear leg compartment panel 56A, wherein first part male fasteners 66A and second part female fasteners 66B engage each other to provide temporary fastening of right front leg compartment panel 55A to right rear leg compartment panel 56A.

This is a simple-to-make covering blanket, wrap or garment that a homemaker, who is a novice in sewing can easily make. This invention, used as a bifurcated wrap-around covering blanket, covers a user's front torso and completely envelops each leg of a user in individual compartments without having to lift the seated user nor a user's legs. My bifurcated wrap-around covering blanket can be applied in the same time it would take to maneuver a flat or other blanket of the prior art. The user's legs are protected by the covering blanket, and a user's buttocks is exposed, obtaining protection from cold air by a seating structure. A user's first leg would be secured into one of said two leg compartments, the covering would then be drawn around the vertical obstruction, and the user's second leg would be secured in the open second leg compartment, and then any open compartments would be closed. The covering blanket can ideally be used on a child seated in a seat with a vertical obstruction between the child's legs in the crotch area, wherein a child can straddle the obstruction, or it can be used on an invalid or handicapped person of any age seated in a wheelchair.

Other embodiments are covering blanket and wrap combinations, and a slacks garment.

This invention can be made in different predetermined sizes, in different predetermined lengths, and in different predetermined materials as deemed appropriate for the particular embodiment use.

This Invention may be Better Understood by Reference to the Accompanying Drawings FIG. 1 shows (a) flexible material 50, (b) upper segment 50F and upper outer sections 50D and 50E, (c) aperture 52, (d) crotch area 54, (e) front leg compartment panels 55 and 55A, (f) the cuts and folds to create the rear leg compartment panels 56 and 56A, (g) the entire leg compartment referred to as 57and 57A, (h) inner segments 58A and 58B forming the aperture 52, (i) inner segments 58C and 58D which segments fasten to inner segments 58A and 58B, (j) 180 degree mark 59 at which to start the circular cut for the top edge of the left rear leg compartment panel which cut ends as shown at the (k) 90 degrees mark 60, and (l) 180 degrees mark 59A at which to start the circular cut for the top edge of the right rear leg compartment panel which cut ends as shown at the (m) 270 degrees mark 60A.

Figure 1A:
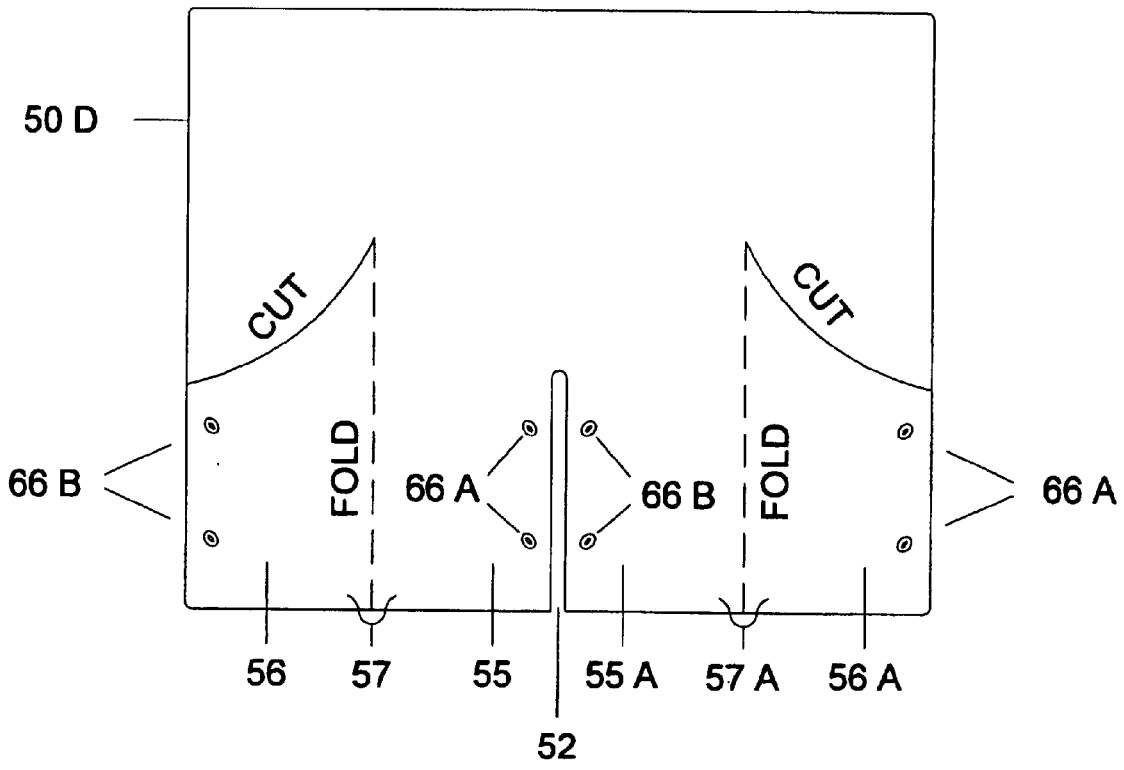
FIG. 1A shows placement of male and female fasteners at the aperture edges comprising inner segments 1,2, 3 and 4 to allow the two leg compartments to be formed as one compartment for both legs.

FIG. 1A shows placement of male fasteners 66A and female fasteners 66B at the aperture 52 edges along inner segments 58A, 58B, 58C and 58D to allow the two leg compartments 57 and 57A to be formed as one compartment for both legs.

FIG. 2 shows the rear leg compartment panels 56 and 56A flipped over and in place, the apex 58 of the aperture 52, the 180 degree marks 59 and 59A, the 90 degree mark 60, the 270 degree mark 60A, the top edges of rear leg compartment panels 64 and 64A, and fastening means 66 along the edges of the aperture and the bottoms of the leg compartments, and first and second lower outer segments 50K and 50L.

Figure 3:
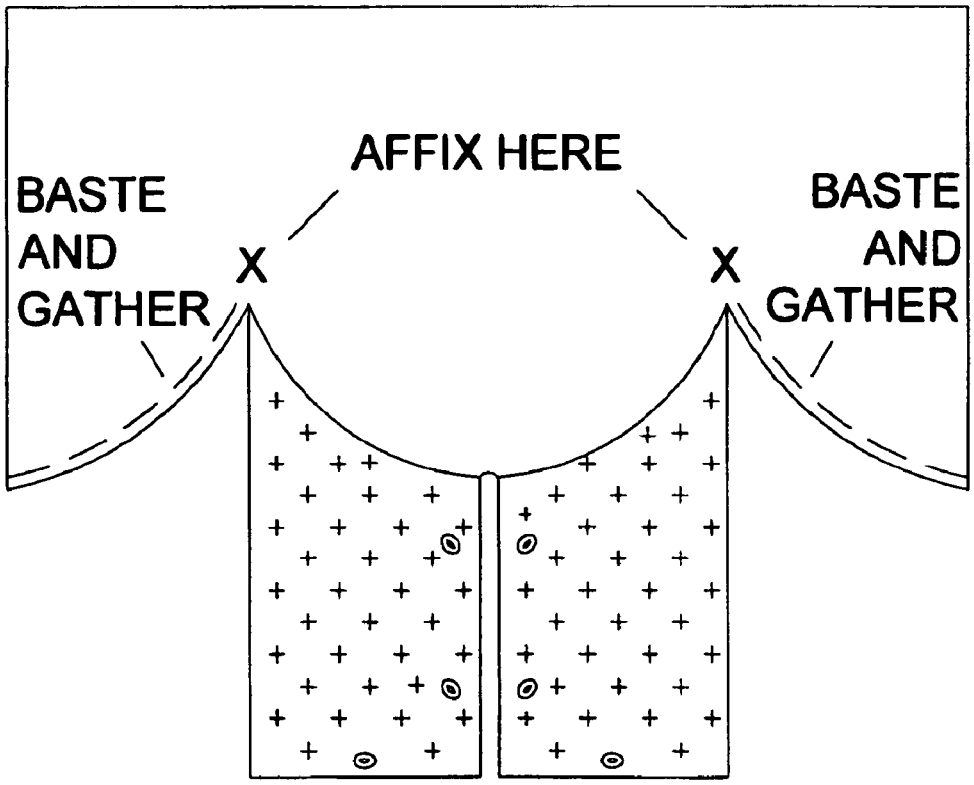
FIG. 3 shows where to baste, gather and affix left and right upper sections of material.

FIG. 3 shows where to baste, gather and affix left and right upper sections of material.

Figure 4:
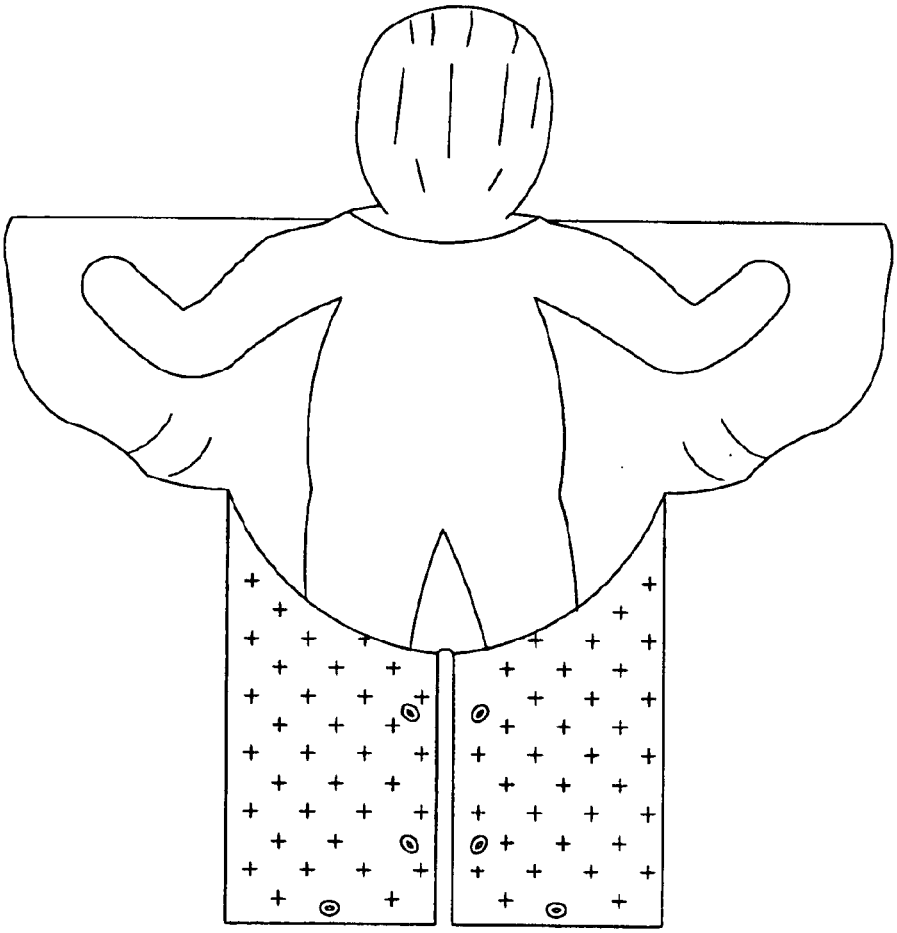
FIG. 4 shows completed bifurcated wrap-around covering blanket with fasteners on the leg compartments, first embodiment of this invention shown from the rear view.

FIG. 4 shows completed blanket with fasteners on the leg compartments, first embodiment of this invention shown from the rear view.

Figure 5:
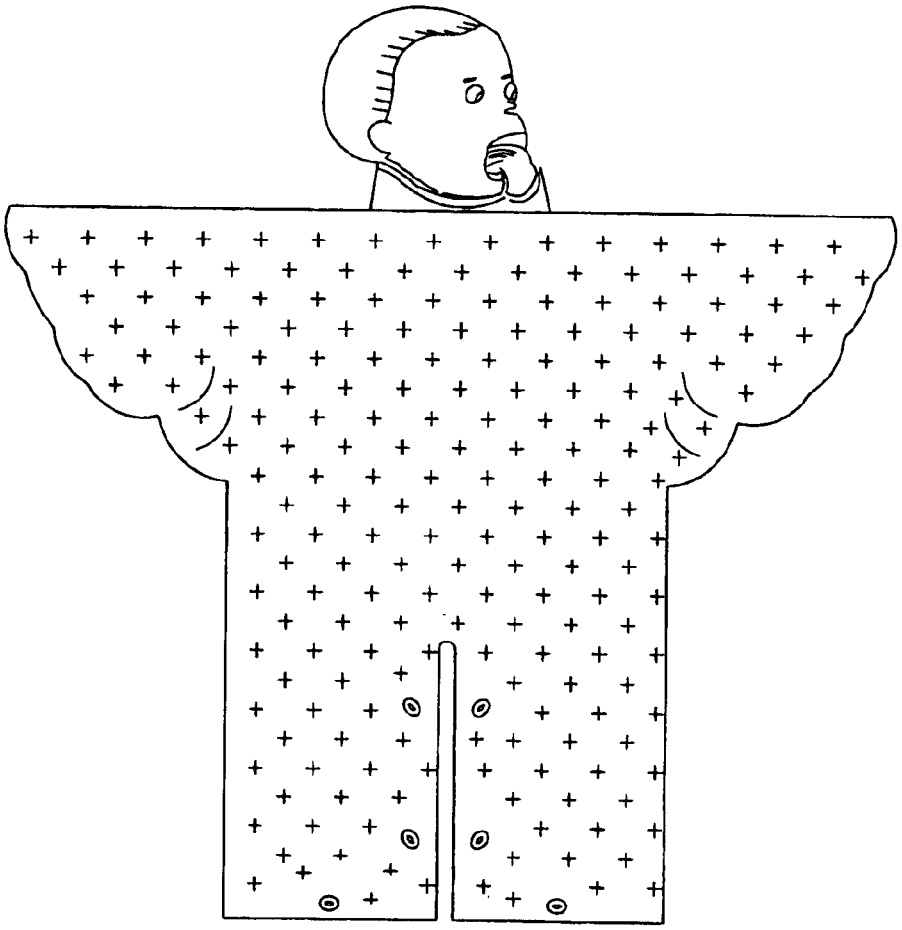
FIG. 5 shows first embodiment of this invention front view.

FIG. 5 shows first embodiment of this invention front view.

Figure 6:
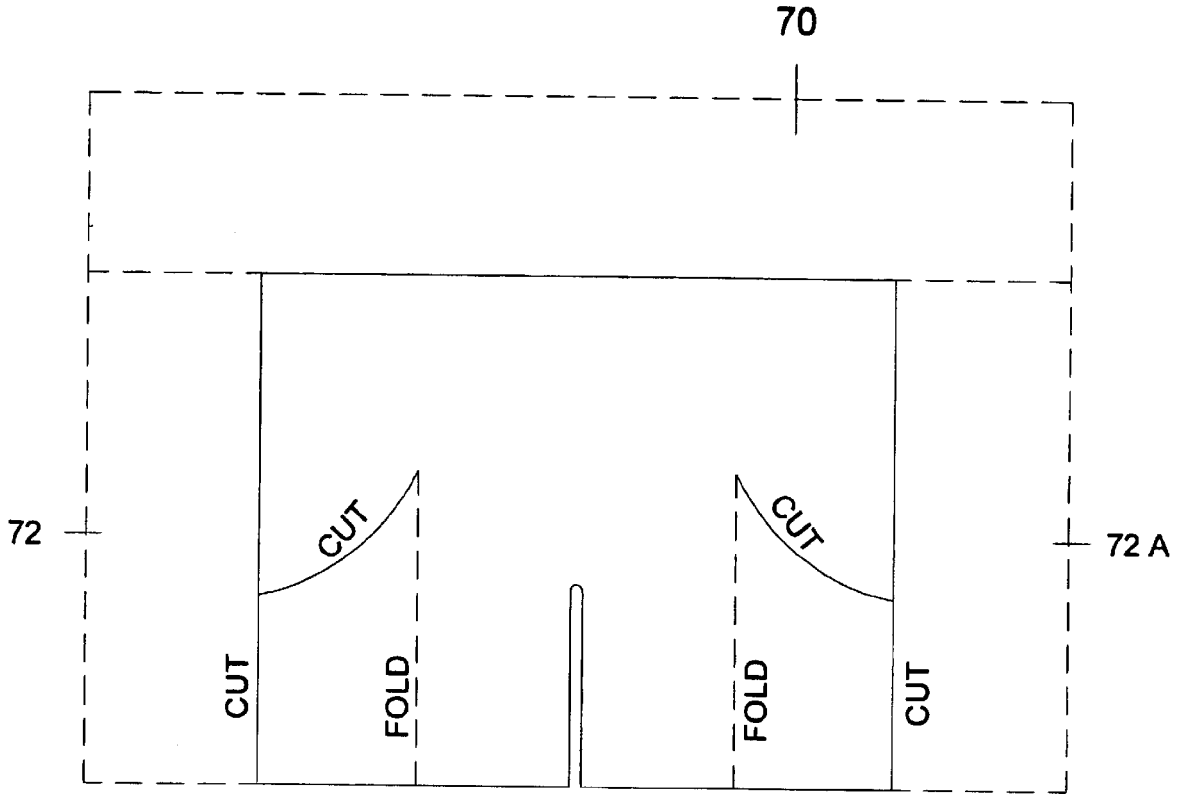
FIG. 6 shows additional flexible material in the longitudinal dimension for a user's head, and additional flexible material in the width, the cuts and folds to create the second embodiment of this invention, which is a combination covering blanket and wrap.

FIG. 6 shows additional flexible material in the longitudinal dimension 70 for the head, and additional flexible material in the width 72 and 72A, the cuts and folds to create the second embodiment of this invention, which is a combination covering blanket and wrap.

Figure 7:
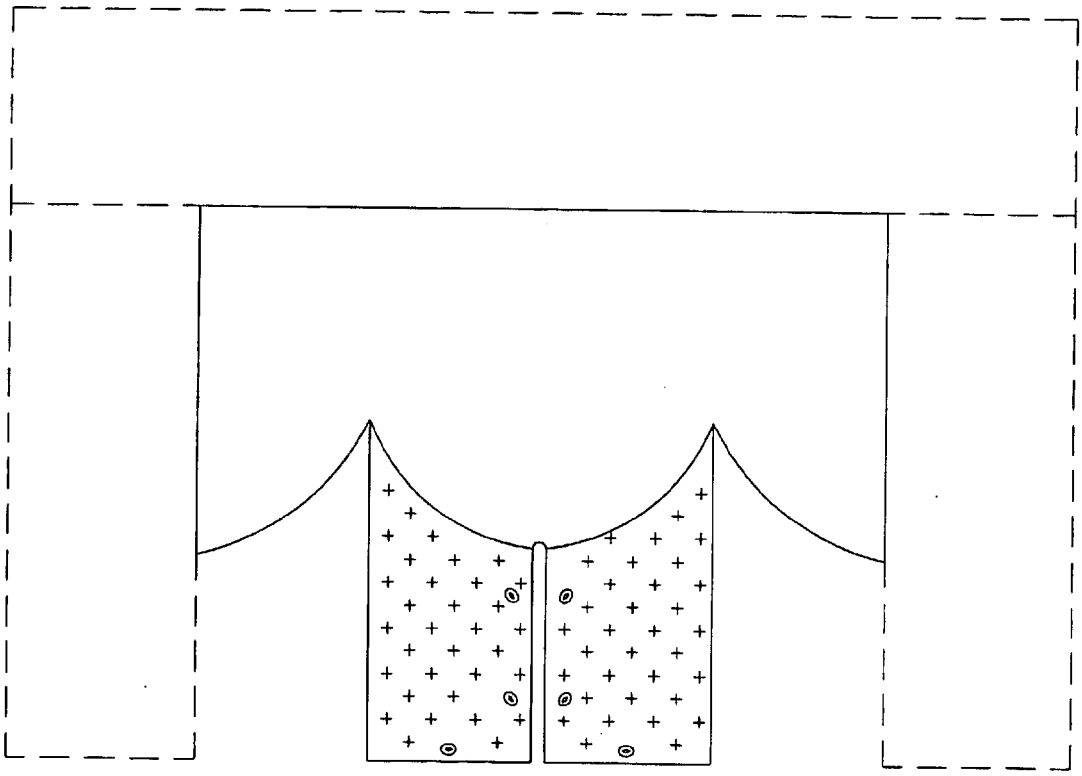
FIG. 7 shows second embodiment rear leg compartment panels flipped over and in place.

FIG. 7 shows second embodiment rear panels 56 and 56A flipped over and in place.

Figure 8:
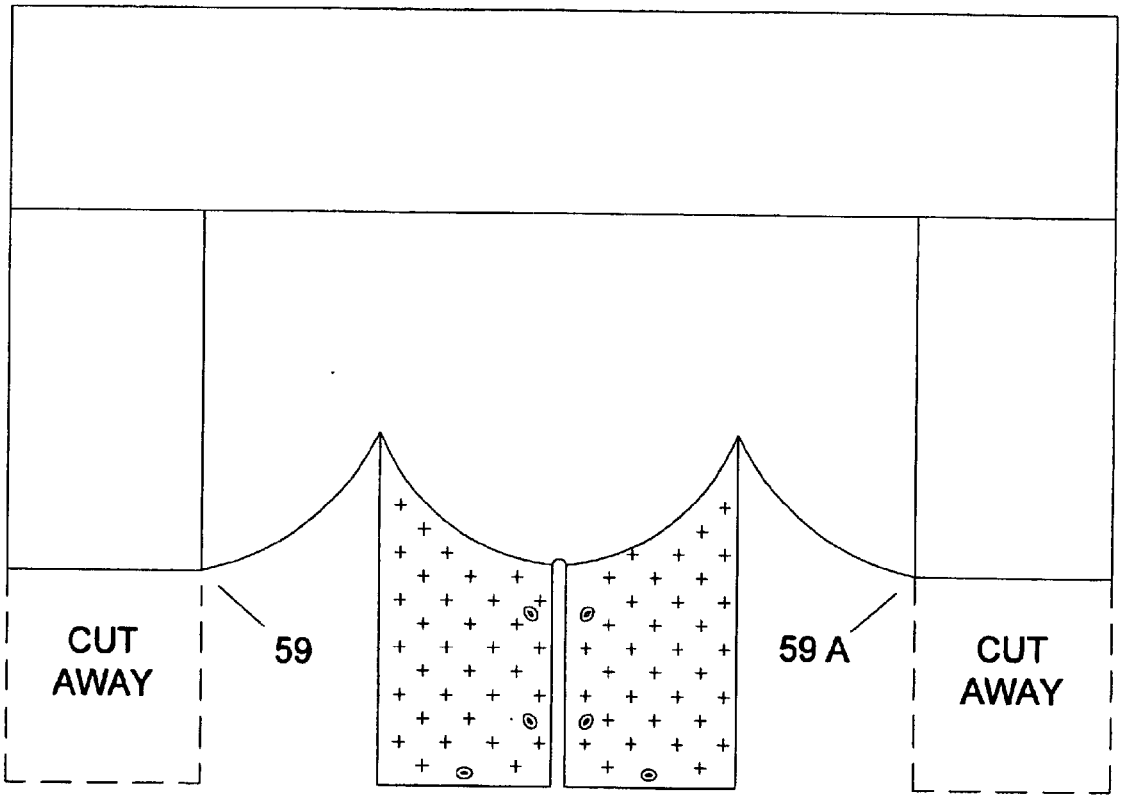
FIG. 8 shows second embodiment lower side section areas to be cut away and discarded.

FIG. 8 shows second embodiment 180 degree marks 59 and 59A, and lower side section areas to be cut away and discarded.

Figure 9:
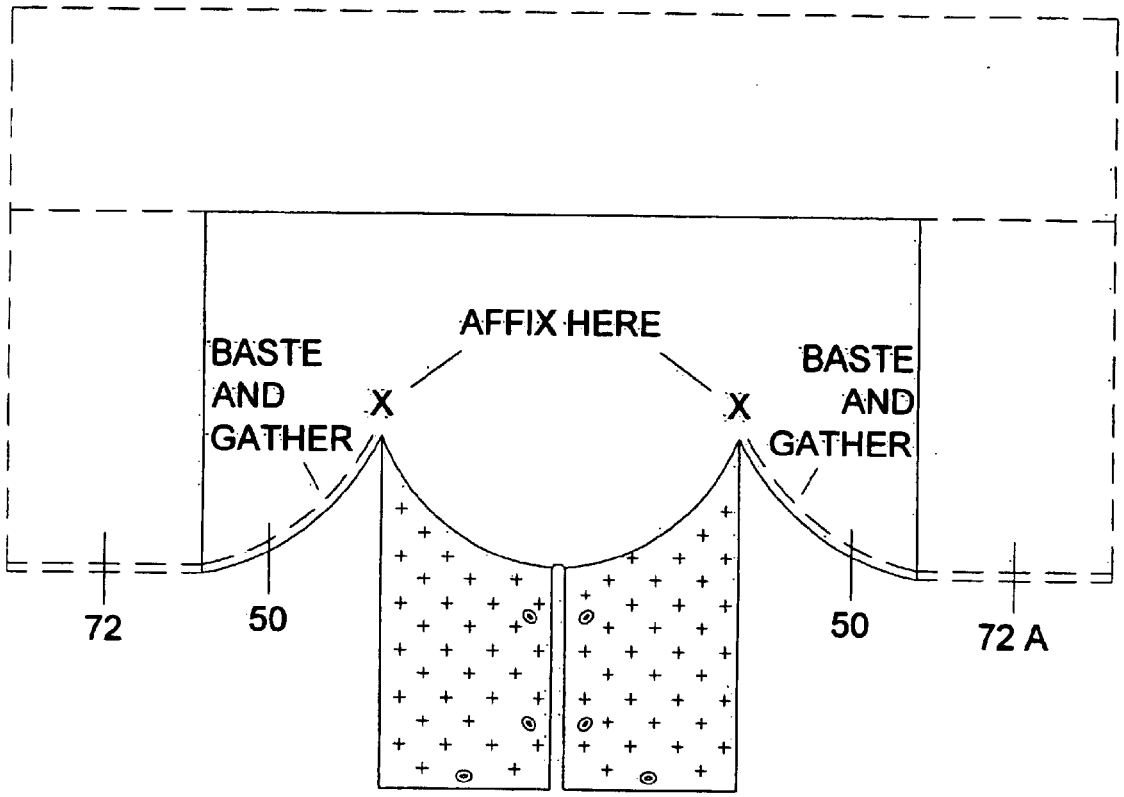
FIG. 9 shows second embodiment where to baste, gather and affix left and right upper sections of material.

FIG. 9 shows second embodiment where to baste, gather and affix left and right upper sections of material 50, 72 and 72A.

Figure 10:
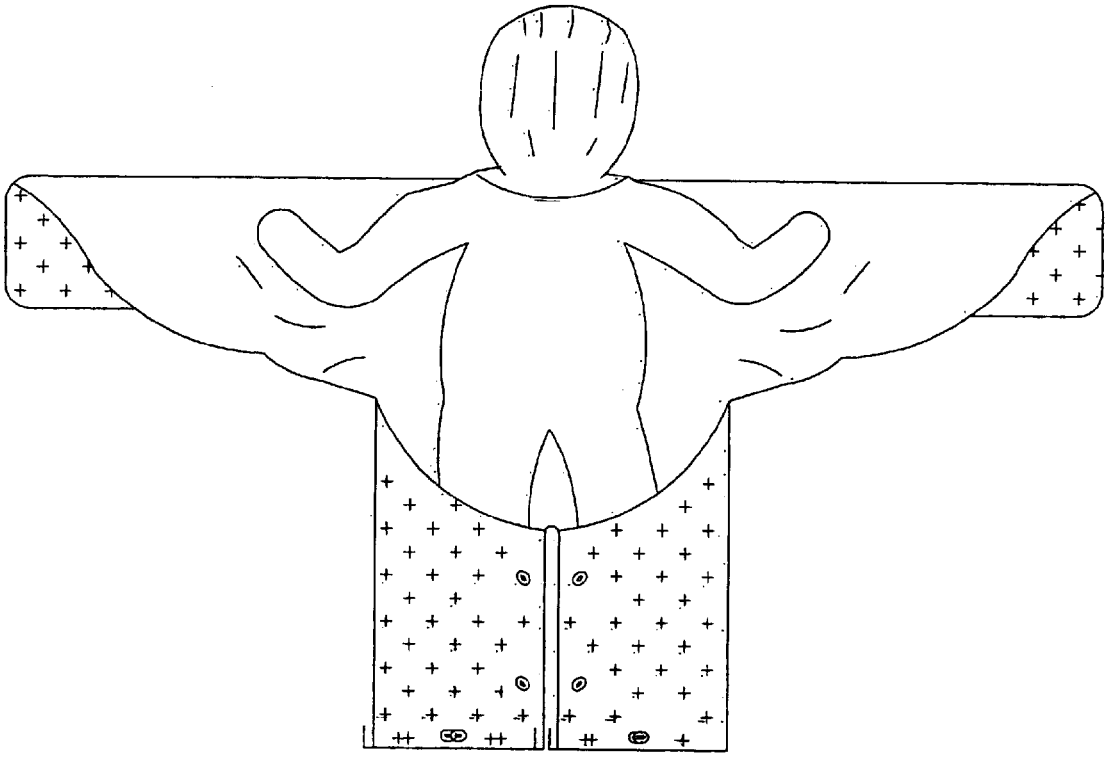
FIG. 10 shows completed bifurcated wrap-around covering as a combination blanket and wrap with fasteners on the leg compartments second embodiment of this invention shown being used as a covering blanket from the rear view.

FIG. 10 shows completed blanket and wrap with fasteners on the leg compartments second embodiment of this invention shown as a covering blanket from the rear view.

Figure 11:
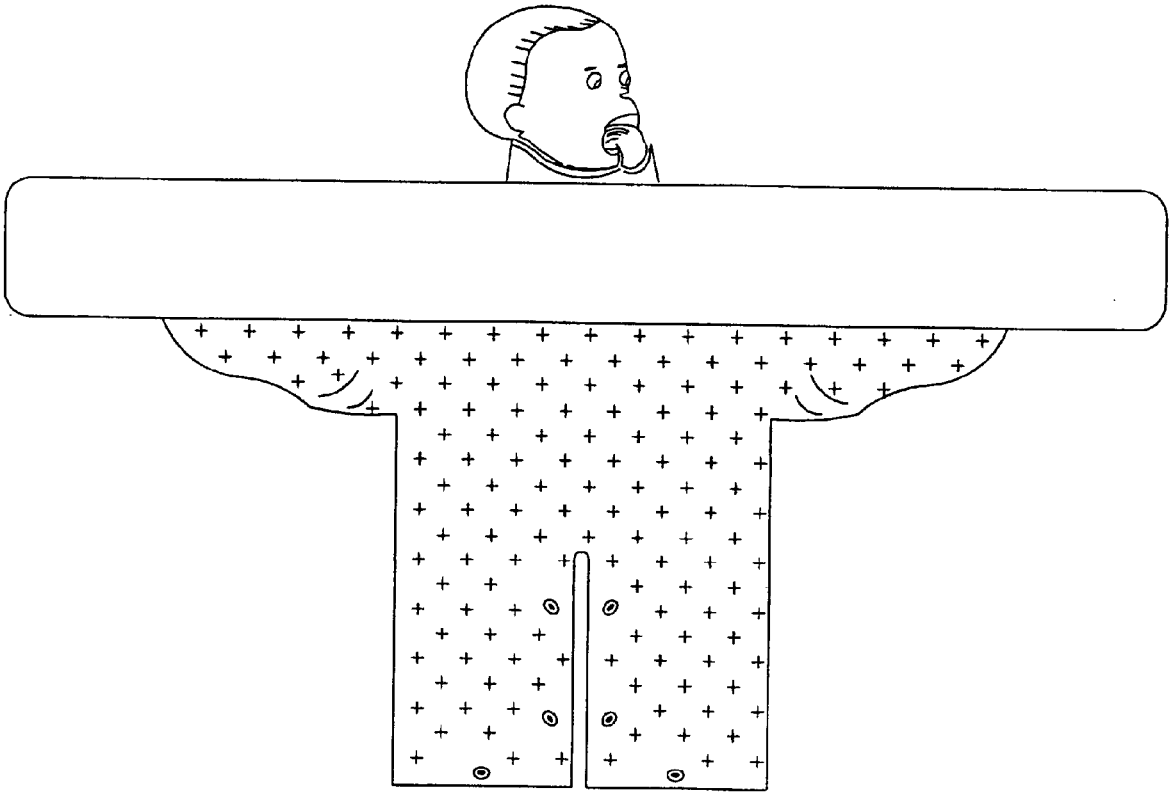
FIG. 11 shows second embodiment of this invention being used as a covering blanket from the front view.

FIG. 11 shows second embodiment of this invention as a covering blanket from front view.

Figure 12:
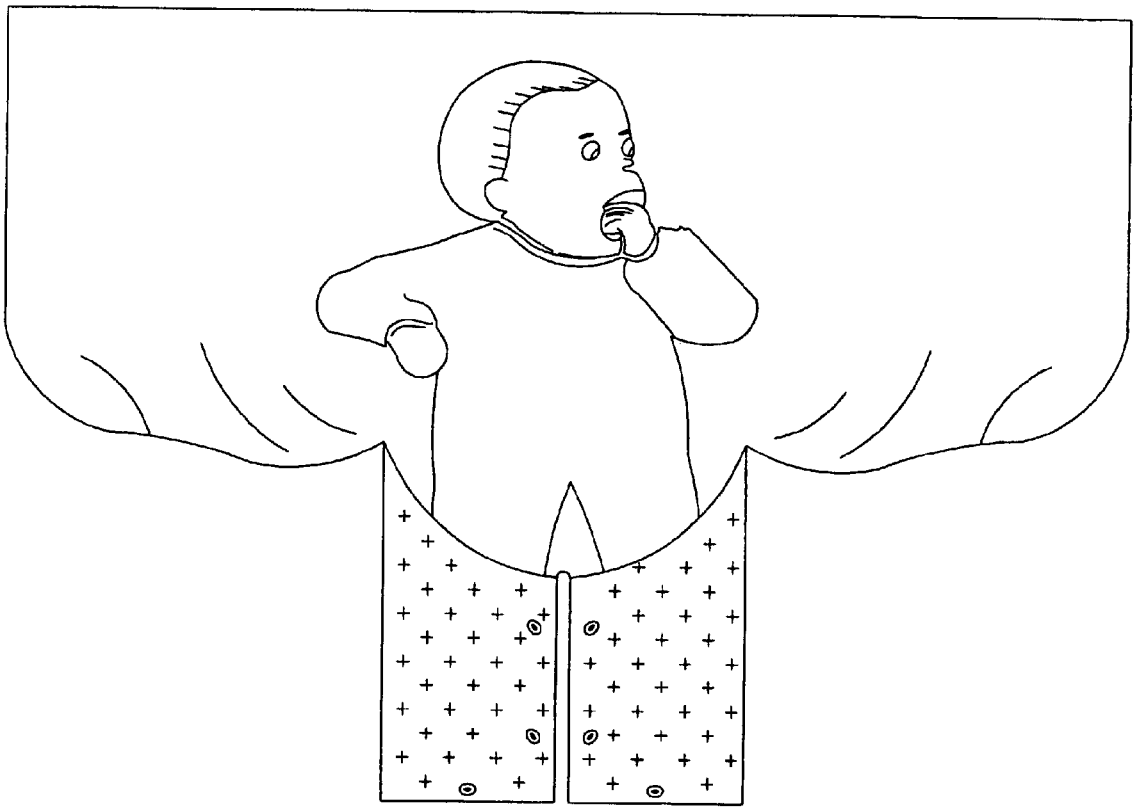
FIG. 12 shows second embodiment of this invention being used as a wrap.

FIG. 12 shows second embodiment of this invention as a wrap.

Figure 13:
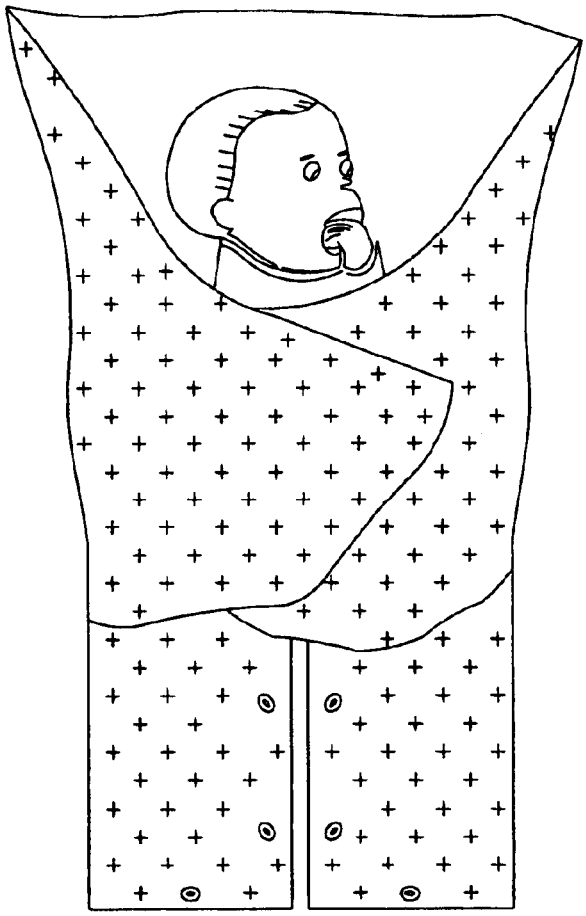
FIG. 13 shows second embodiment of this invention with a person wrapped up.

FIG. 13 shows second embodiment of this invention with a person wrapped up.

Figure 14:
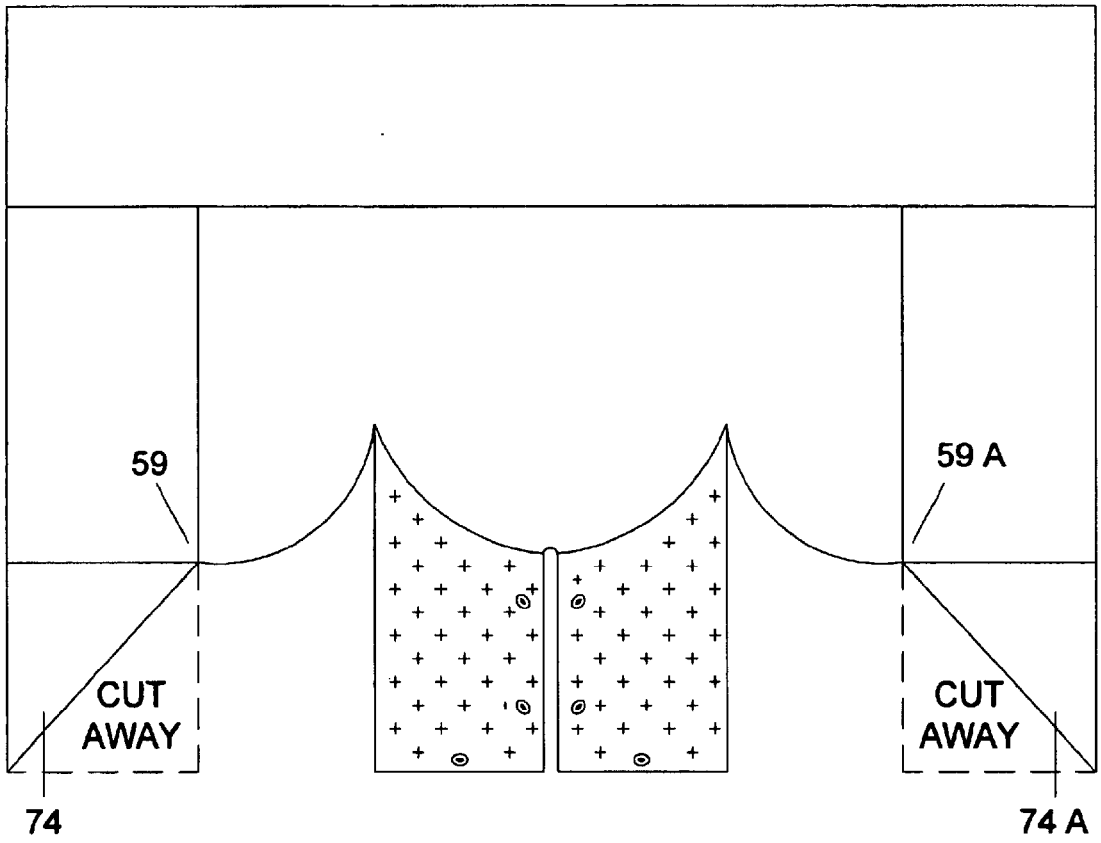
FIG. 14 shows third embodiment, combination covering blanket and wrap, rear leg compartment panels flipped over and in place, and triangular diagonally cut lower side sections to be attached to sides of leg compartments hereinafter referred to as wings.

FIG. 14 shows third embodiment, combination covering blanket and wrap, rear panels 56 and 56A flipped over and in place, and triangular diagonally-cut lower side sections to be cut to the 180 degrees marks 59 and 59A and remaining triangular diagonally-cut sections, wings 74 and 74A to be attached to sides of leg compartments.

Figure 15:
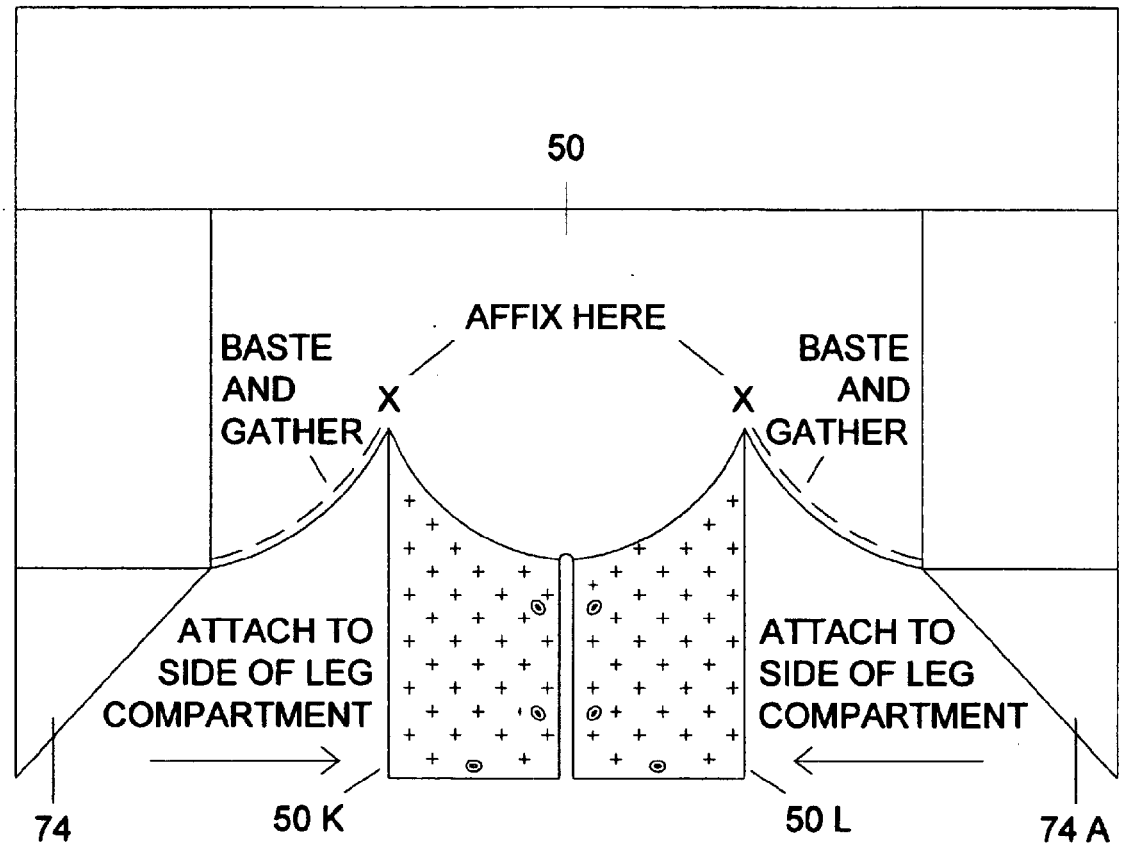
FIG. 15 shows third embodiment where to baste, gather and affix left and right sections of material, and attach the lower triangular sections, wings, to the sides of the leg compartments.
Figure 16:
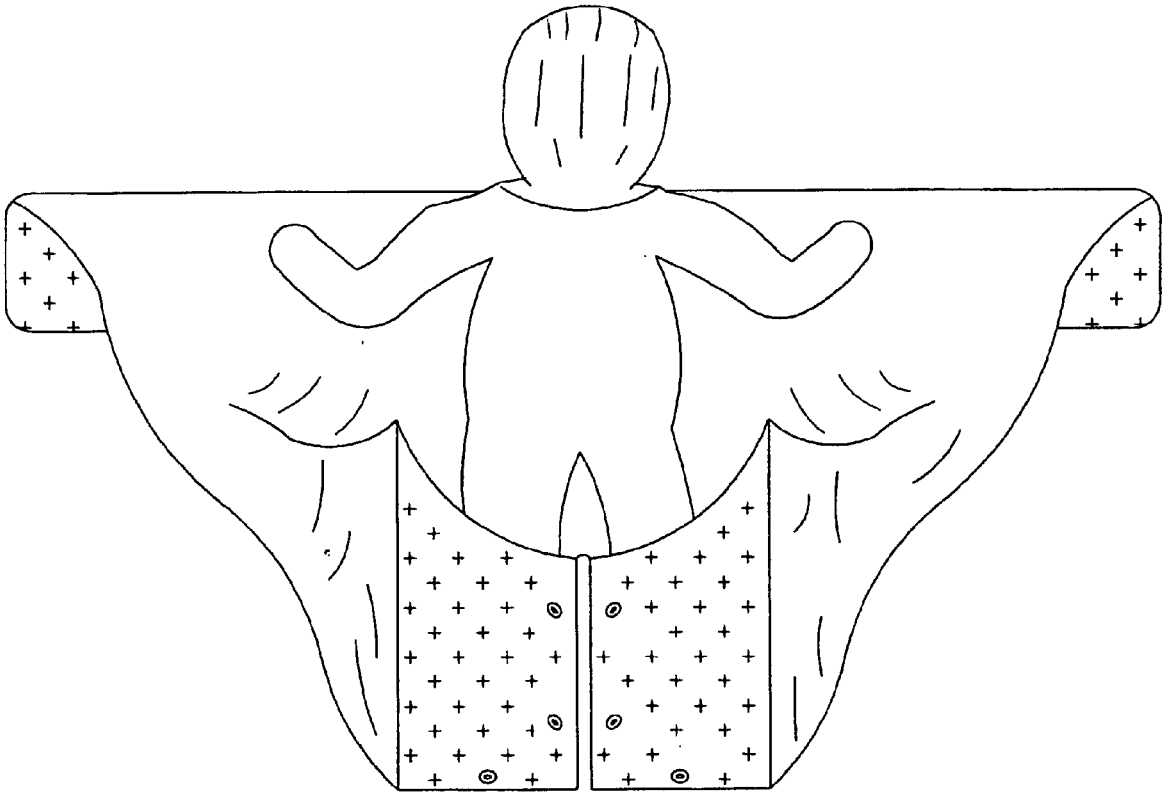
FIG. 16 shows completed bifurcated wrap-around covering combination blanket and wrap with fasteners on the leg compartments third embodiment shown being used as a covering blanket from the rear view.

FIG. 15 shows third embodiment where to baste, gather and affix left and right sections of material 50, and attach the wings 74 and 74A to the sides of the leg compartments lower outer segments 50K and 50L FIG. 16 shows completed blanket and wrap with fasteners on the leg compartments third embodiment of this invention shown as a covering blanket from the rear view.

Figure 17:
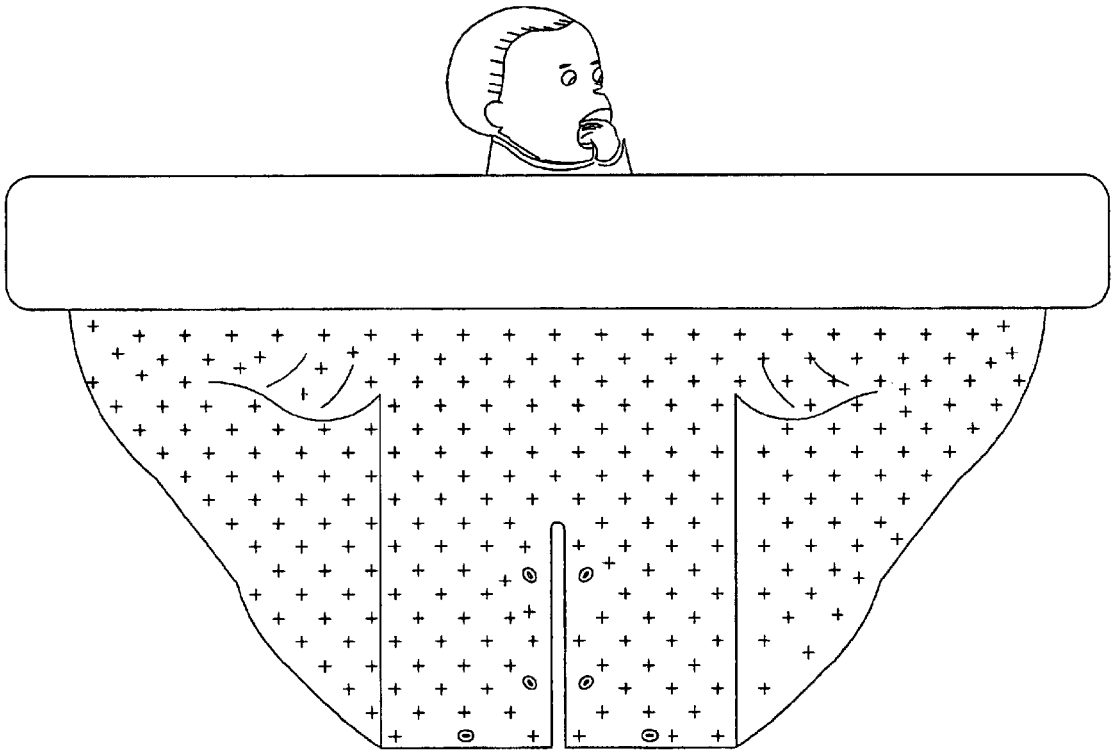
FIG. 17 shows third embodiment being used as a covering blanket from the front view.

FIG. 17 shows third embodiment of this invention as a covering blanket from front view.

Figure 18:
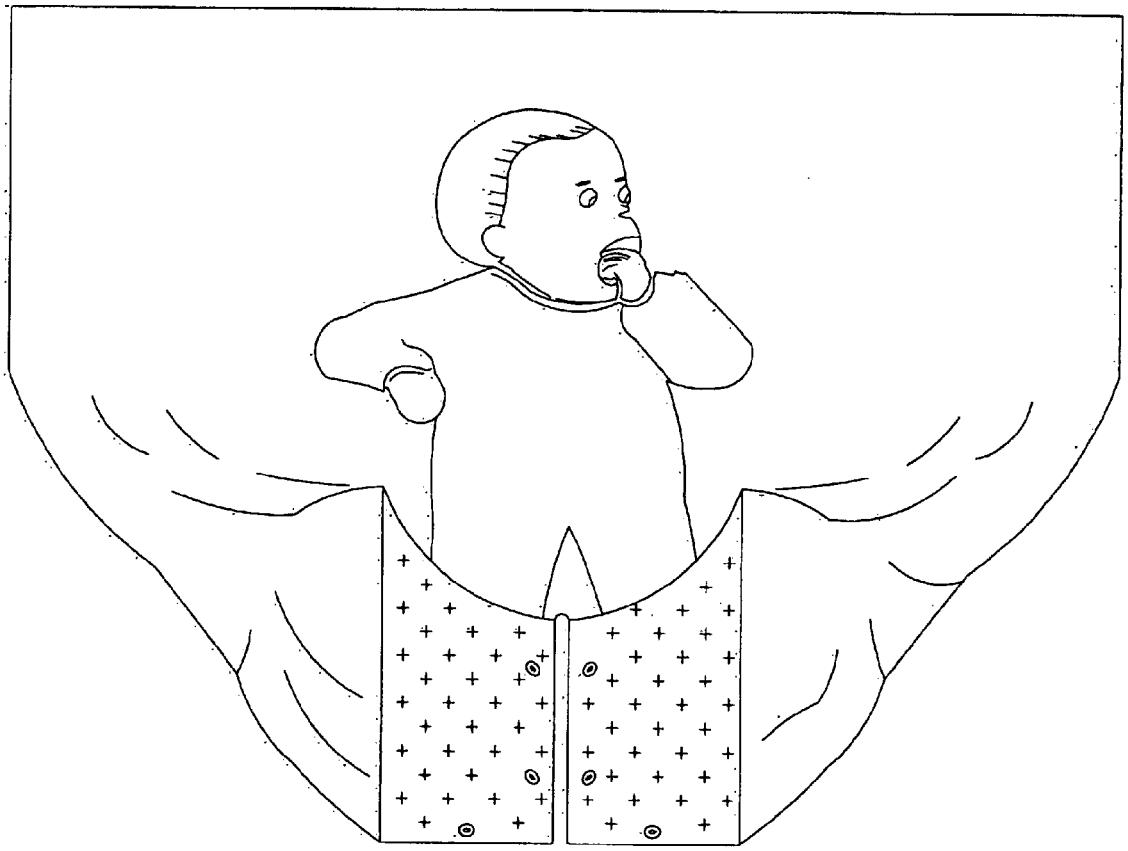
FIG. 18 shows third embodiment being used as a wrap.

FIG. 18 shows third embodiment of this invention as a wrap.

Figure 19:
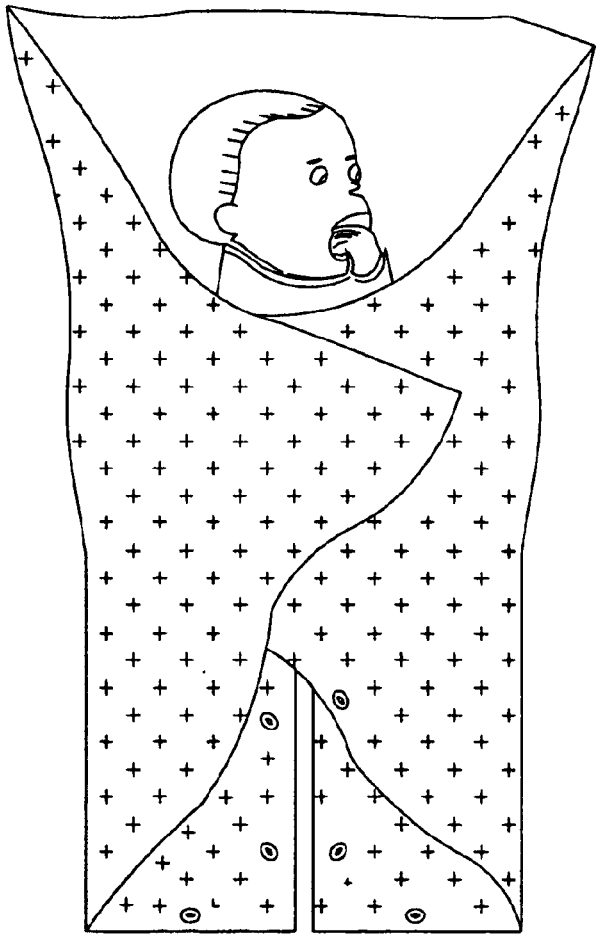
FIG. 19 shows third embodiment with a person wrapped up.

FIG. 19 shows third embodiment of this invention with a person wrapped up.

Figure 20:
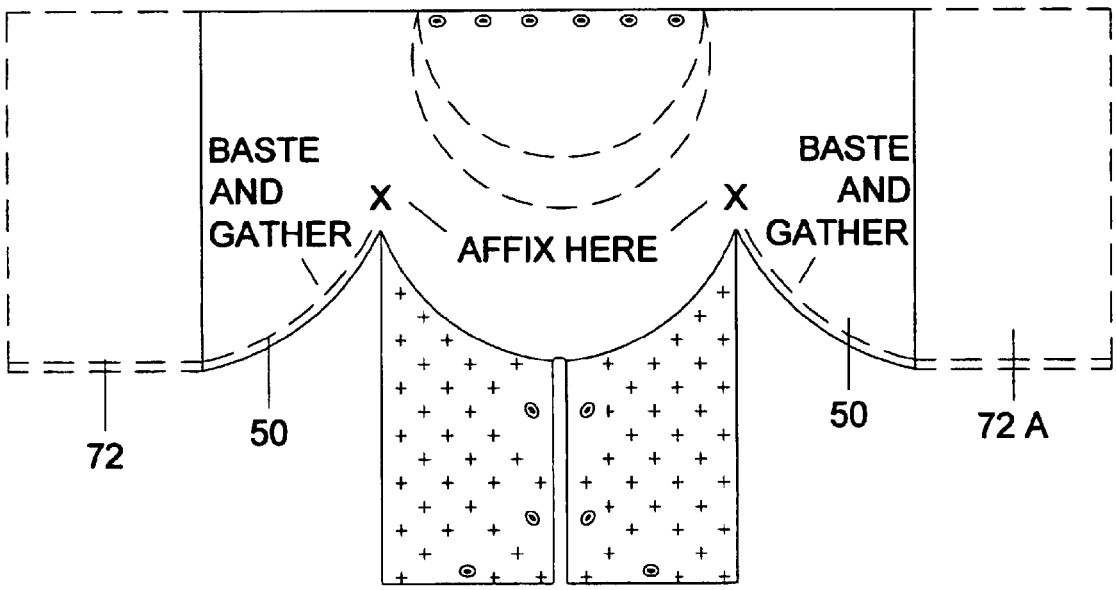
FIG. 20 shows fourth embodiment, combination covering blanket and wrap, wide with hood, rear leg compartment panels flipped over and in place, shows where to baste, gather and affix left and right sections of material.

FIG. 20 shows fourth embodiment, combination covering blanket and wrap, wide with hood, rear panels 56 and 56A flipped over and in place, shows where to baste, gather and affix left and right sections of material 50, 72 and 72A.

Figure 21:
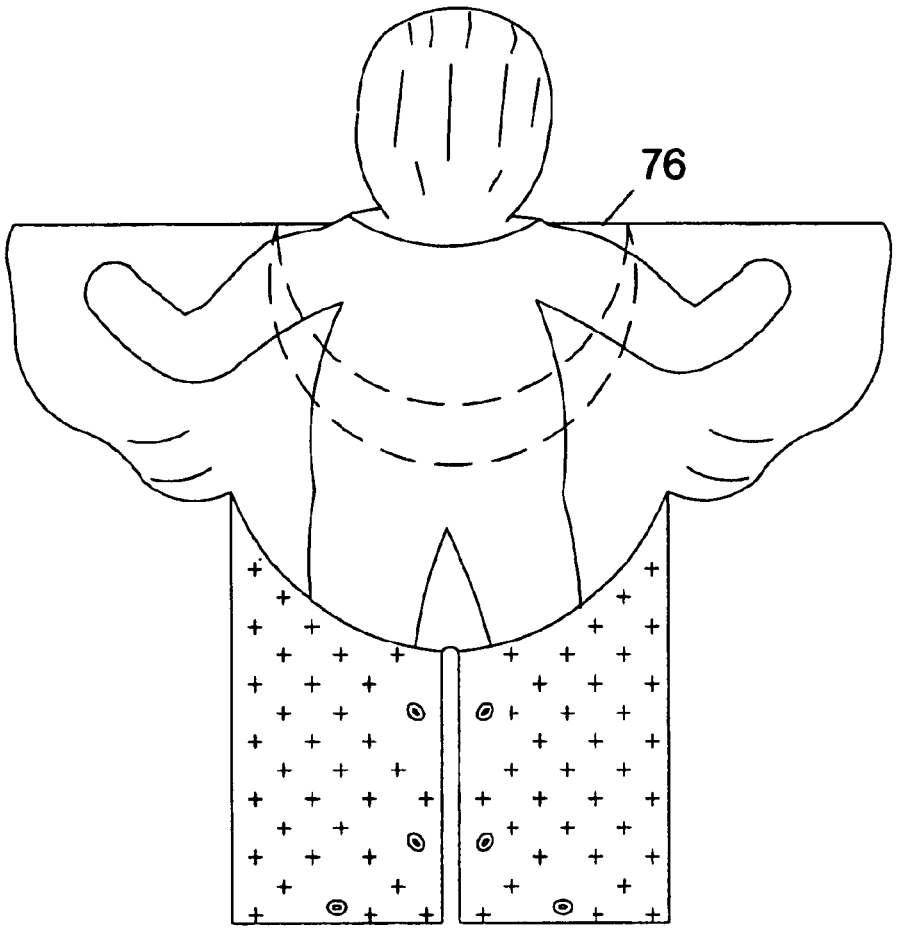
FIG. 21 shows fourth embodiment, combination covering blanket and wrap with removable hood, shown being used as a covering blanket, rear view.

FIG. 21 shows fourth embodiment, combination covering blanket and wrap with removable hood 76, attached, shown being used as a covering blanket, rear view.

Figure 22:
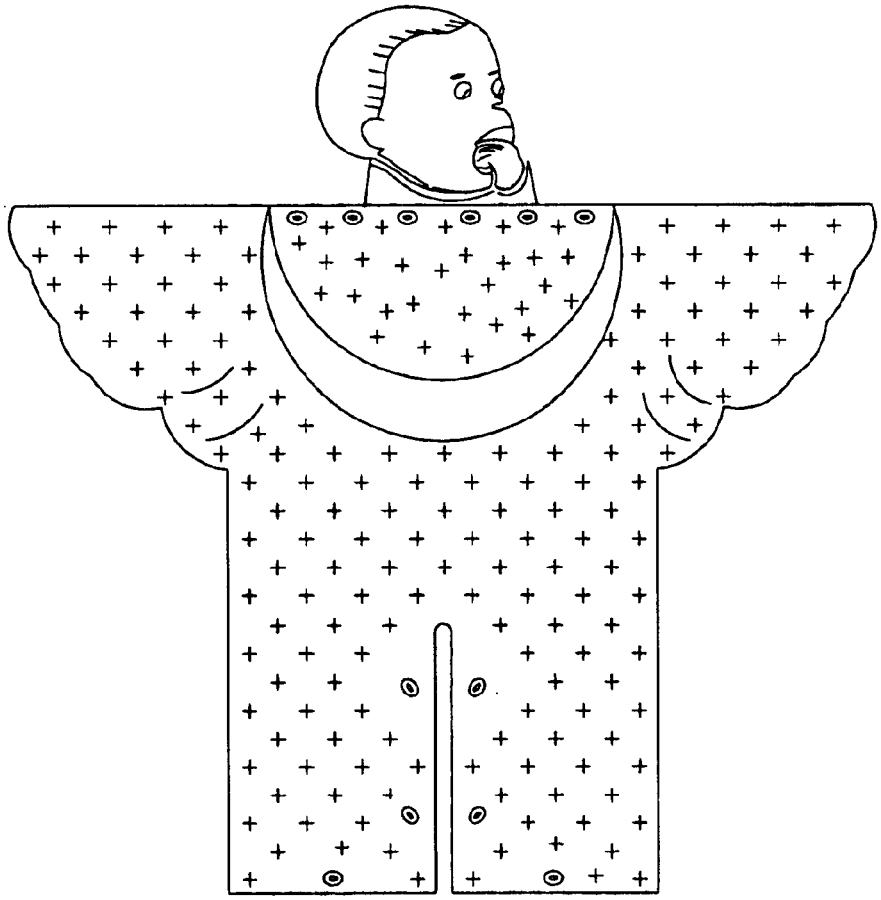
FIG. 22 shows fourth embodiment, combination covering blanket and wrap with removable hood, shown being used as a covering blanket, front view.

FIG. 22 shows fourth embodiment, combination covering blanket and wrap with removable hood, shown being used as a covering blanket, front view.

Figure 23:
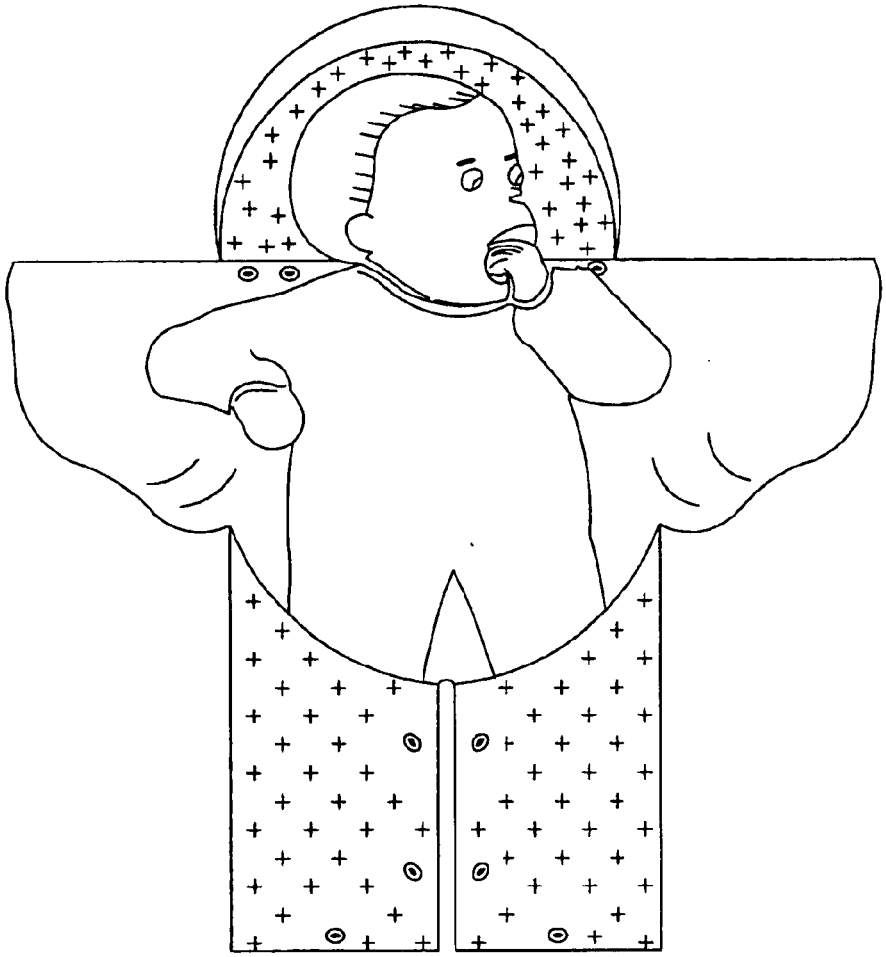
FIG. 23 shows fourth embodiment, combination covering blanket and wrap with removable hood, shown being used as a wrap.

FIG. 23 shows fourth embodiment, combination covering blanket and wrap with removable hood, shown being used as a wrap.

Figure 24:
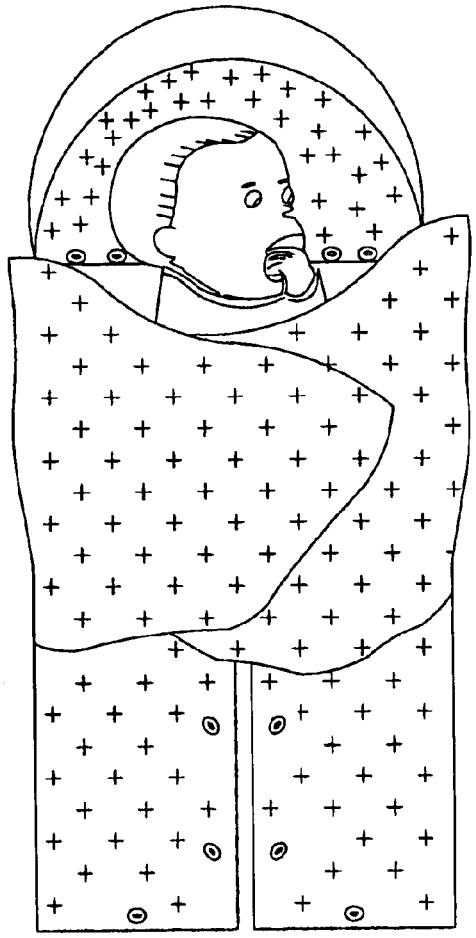
FIG. 24 shows fourth embodiment, combination covering blanket and wrap with removable hood, with a person wrapped up.

FIG. 24 shows fourth embodiment, combination covering blanket and wrap with removable hood, with a person wrapped up.

Figure 25:
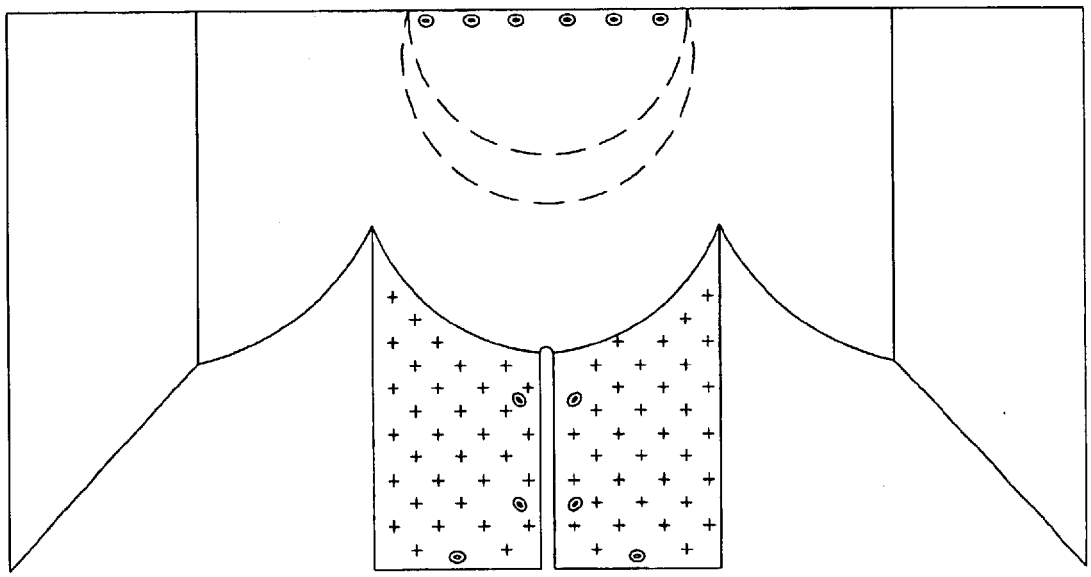
FIG. 25 shows fifth embodiment, combination covering blanket and wrap, wide with hood, with triangular lower diagonally-cut sections, wings, rear leg compartment panels flipped over and in place.

FIG. 25 shows fifth embodiment, combination covering blanket and wrap, wide with removable hood 76, triangular diagonally-cut lower section, wings 74 and 74A, rear panels 56 and 56A flipped over and in place.

Figure 26:
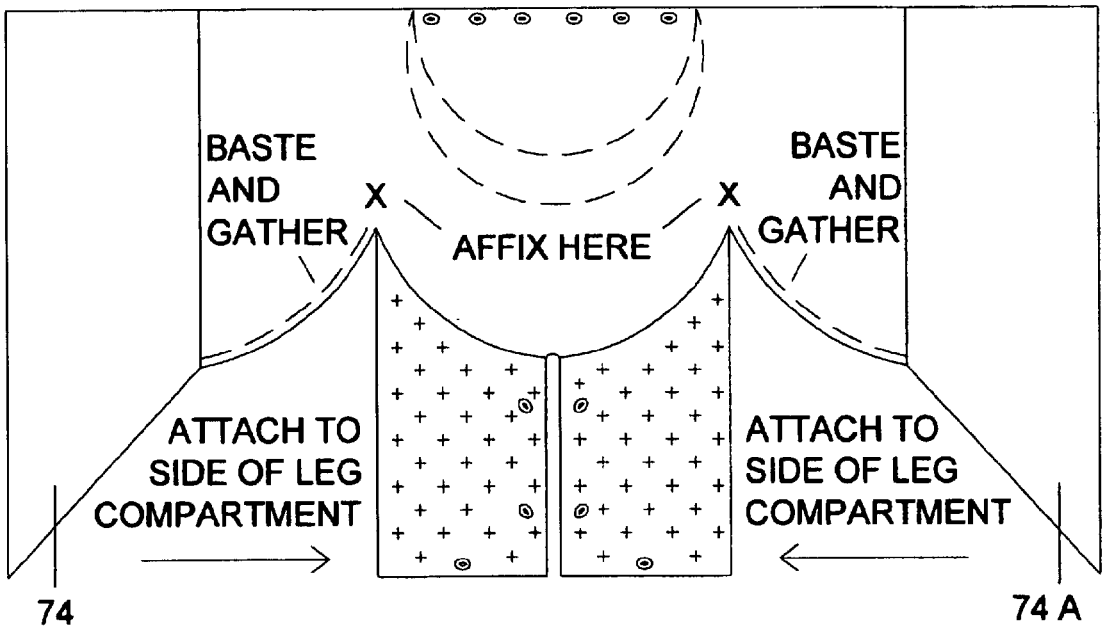
FIG. 26 shows fifth embodiment combination covering blanket and wrap with removable hood, where to baste, gather and affix left and right sections of material, and triangular diagonally-cut lower side sections, wings, to be attached to sides of leg compartments.

FIG. 26 shows fifth embodiment combination covering blanket and wrap with removable hood 76, where to baste, gather and affix left and right sections of material 50, and wings 74 and 74A to be attached to sides of leg compartments lower outer segments 50K and 50L.

Figure 27:
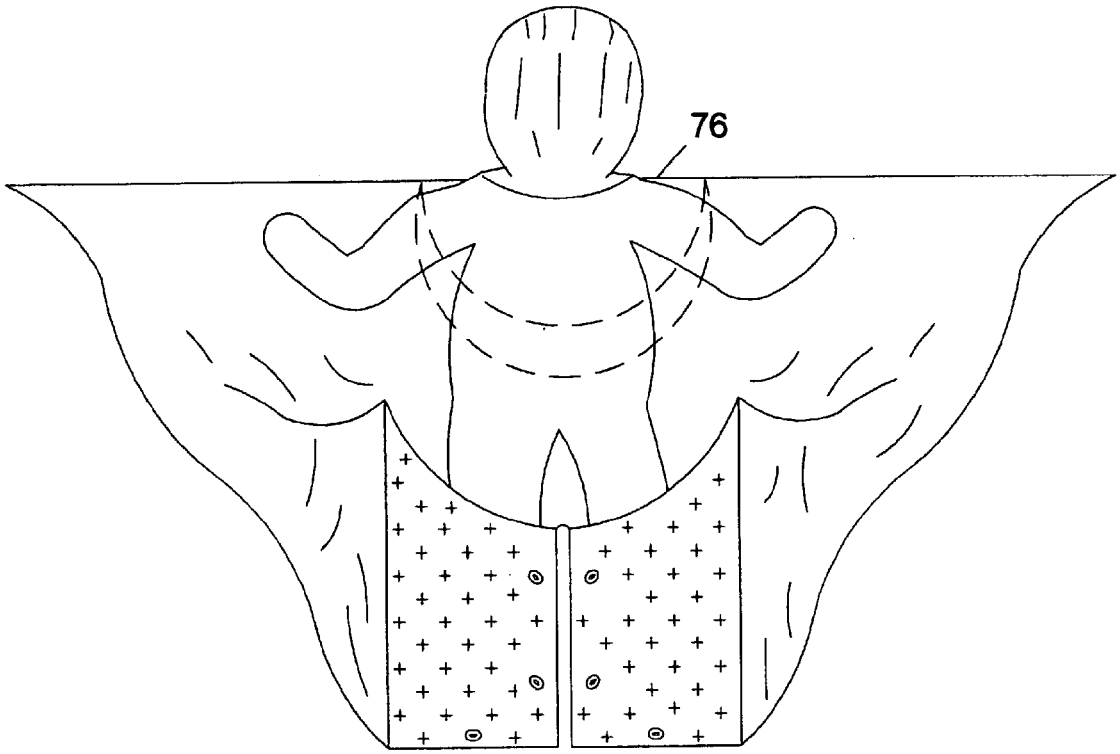
FIG. 27 shows fifth embodiment combination covering blanket and wrap with removable hood, shown being used as a covering blanket, rear view.

FIG. 27 shows fifth embodiment combination covering blanket and wrap with removable hood 76, shown being used as a covering blanket, rear view.

Figure 28:
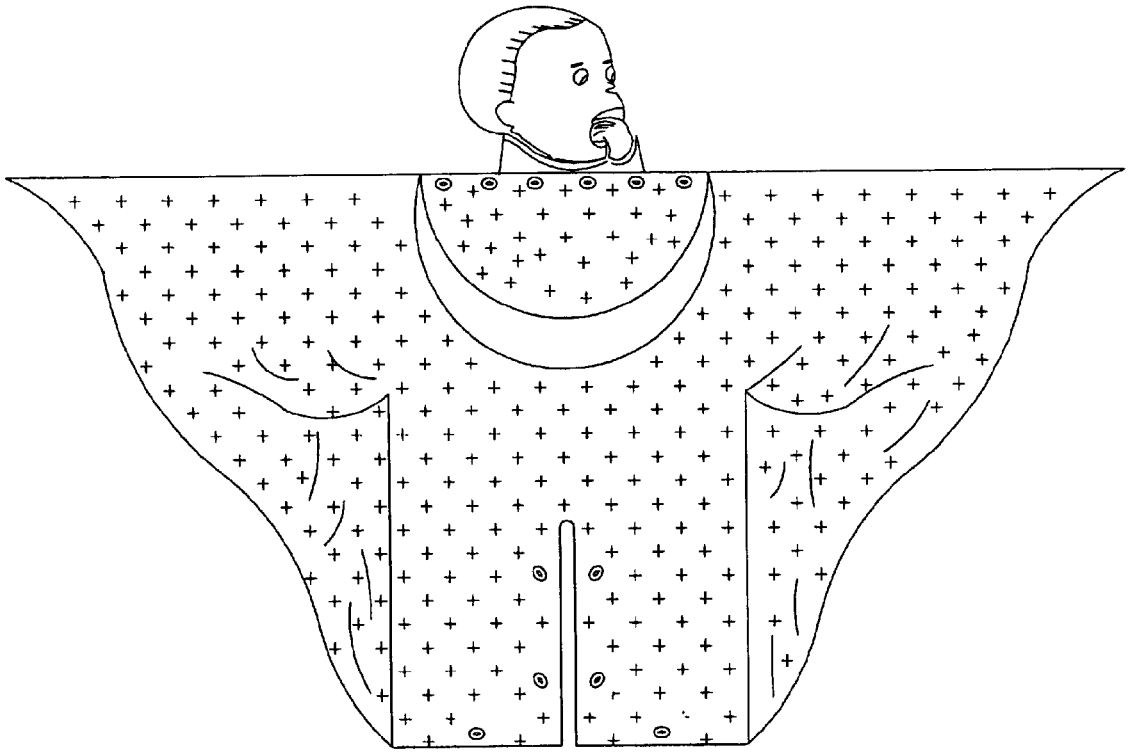
FIG. 28 shows fifth embodiment combination covering blanket and wrap with removable hood, shown being used as a covering blanket, front view.

FIG. 28 shows fifth embodiment combination covering blanket and wrap with removable hood 76, shown being used as a covering blanket, front view.

Figure 29:
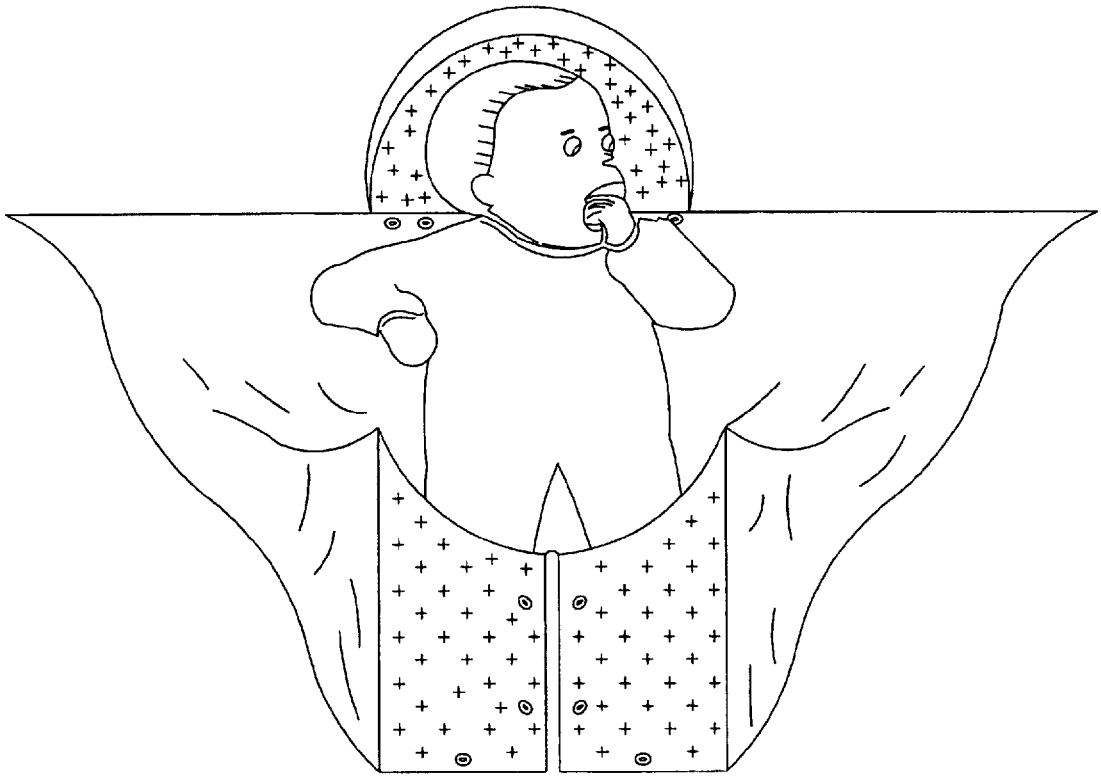
FIG. 29 shows fifth embodiment combination covering blanket and wrap with removable hood, shown being used as a wrap.

FIG. 29 shows fifth embodiment combination covering blanket and wrap with removable hood 76, shown being used as a wrap.

Figure 30:
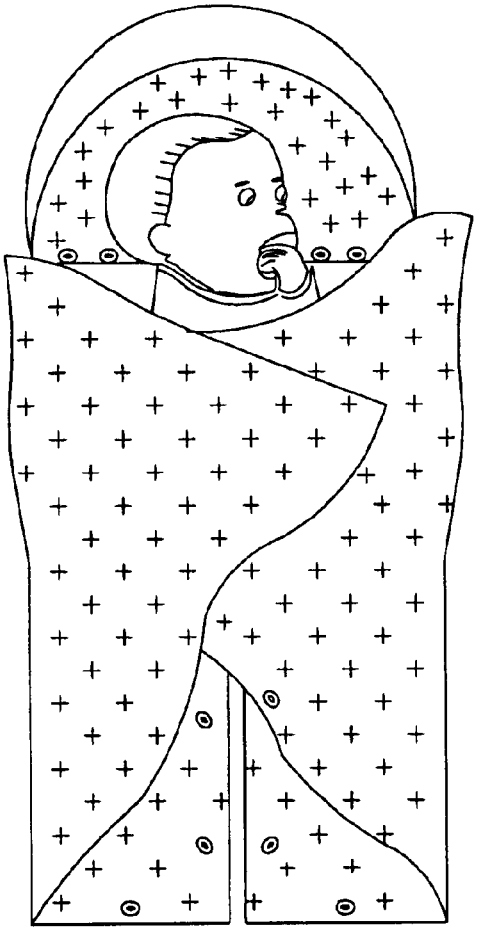
FIG. 30 shows fifth embodiment combination covering blanket and wrap with removable hood, with a person wrapped up.

FIG. 30 shows fifth embodiment combination covering blanket and wrap with removable hood 76, with a person wrapped up.

FIG. 31 shows sixth embodiment, a covering blanket. Leg compartment rear panels 56 and 56A have been cut from a separate piece of material 50. Outside edges of rear panels 56 and 56A have been sewn to the flexible material 50.

FIG. 32 shows seventh embodiment, combination covering blanket and wrap, with additional material 70 for a person's head for when used as a wrap.

FIG. 33 shows seventh embodiment, combination covering blanket and wrap with additional material 70 for a person's head for when used as a wrap, shown being used as a covering blanket, rear view.

FIG. 34 shows seventh embodiment, combination covering blanket and wrap, with additional material 70 for a person's head when used as a wrap, shown being used as a covering blanket, front view.

FIG. 35 shows seventh embodiment, combination covering blanket and wrap, with additional material 70 for a person's head for when used as a wrap.

FIG. 36 shows seventh embodiment, combination covering blanket and wrap, with additional material 70 for a person's head for when used as a wrap, with a person wrapped up.

FIG. 37 shows eighth embodiment, combination covering blanket and wrap with removable hood 76, leg compartments rear panels 56 and 56A have been cut from a separate piece of material 50. Outside edges of rear leg compartment panels 56 and 56A have been sewn to material 50.

FIG. 38 shows eighth embodiment, combination covering blanket and wrap with removable hood 76, shown being used as a covering blanket, rear view.

FIG. 39 shows eighth embodiment, combination covering blanket and wrap with removable hood 76, shown being used as a covering blanket, front view.

FIG. 40 shows eighth embodiment, combination covering blanket and wrap with removable hood 76, shown being used as a wrap.

FIG. 41 shows eighth embodiment, combination covering blanket and wrap with removable hood 76, with a person wrapped up.

FIG. 42 shows ninth embodiment cuts of the material prepared for a slacks garment.

FIG. 43 shows ninth embodiment slacks garment privacy flaps 82 and 82A and ties 86 and 86A.

FIG. 43A shows ninth embodiment upper section of material 50 above left rear leg panel 56 is lifted, shows underwear 84 on a person's buttocks.

FIG. 43B shows ninth embodiment left leg privacy panel 82 is sewn to material 50 above left rear leg panel top edge 64.

FIG. 44 shows extensions to the rear leg compartment panels 56 and 56A which extensions are in actuality, a second set of front leg compartment panels 68 and 68A that attach to inner segments 58C and 58D and wrap over the first set of front panels 55 and 55A in embodiments 10 through 15.

FIG. 45 shows embodiment 15 slacks garment, ties 86 and 86A at upper outside corners of garment, and privacy flap 82 has been added to the second front leg compartment panel 68, and additional tie 88 is added to privacy flap 82, and privacy flap 82A has been added to the second front leg compartment panel 68A, and additional tie 88A is added to privacy flap 82A.

FIG. 46 shows embodiment 15, second set of front leg compartment panels 68 and 68A are in place. Upper section of material above left rear leg panel 56 is lifted, underwear on buttocks 84 is exposed.

FIG. 47 shows embodiment 15, left leg privacy flap 82 is shown attached to second front leg compartment panel 68 of left leg compartment.

FIG. 48: shows from between inner segments 58A and 58C, view through 55 and 56 showing male 66A and female 66B fastening snaps engaged.

1st Embodiment, Preferred Embodiment, How to Make

FIG. 1: Start with a piece of flexible material 50 of a chosen size, approximately 30"x 36" for an infant-sized blanket. Designate a top and a bottom. At the point of the center of the bottom edge which is between lower segments 50G and 50H, make a cut upwards approximately 6" longer than desired leg length. Trim away approximately ½" of material from each cut edge to create first and second inner segments 58A and 58B. This opening is called the aperture 52. From the bottom outer edge of the left side of flexible material 50 which is lower segment 501, measure a distance upward along the edge of the material the same length as the length of the aperture to a point which is designated 180 degrees 59 of a circle. Start cutting from this 180 degrees mark 59, circularly to the right to a point approximately 90 degrees 60. By this cut you will have established along the left edge of flexible material, first upper outer segment 50D and third inner segment 58C. Inner segment 58C will later fasten between a person's legs to inner segment 58A, closing the left leg compartment. Repeat this same step on the right side. From the bottom outer edge of the right side of the material 50 which is lower segment 501, measure a distance upward along the edge of flexible material the same length as the length of the aperture to a point which is designated 180 degrees 59A of a circle. Start cutting from this 180 degrees mark 59A circularly to the left to a point approximately 270 degrees 60A. By this cut you will have established along the right edge of flexible material, upper outer segment 50E and fourth inner segment 58D. Inner segment 58D will later fasten between a person's legs to inner segment 58B, closing the right leg compartment. Once both cuts have been made the lower cut edges become the top edges 64 and 64A of the rear leg compartment panels 56 and 56 of the leg compartments 57 and 57A. The circular cuts will surround the seated buttocks, giving protection to a user's lower hip area where lower hip and thigh adjoin, so keep that in mind when deciding how wide and how rounded you want these cuts to be. If this blanket is for an infant, keep in mind that the leg compartments should be wide enough for an infant to be able to flex his legs within the leg compartment. Finish all edges. The aperture 52 and circular cuts can be serged or finished with bias tape or seam tape or some other securing trim. Other edges that are straight can be simply folded over and sewn.

FIG. 1A: Male 66A and female 66B fasteners placed strategically will allow the separate leg compartments to be combined into one compartment that will contain both legs. This is accomplished simply by placing male fasteners 66A on the left front leg compartment panel 55, and female fasteners 66B on the left rear leg compartment panel 56 as expected. Then reverse this placement for the right leg compartment. Place female fasteners 66B on the right front leg compartment panel 55A and male fasteners 66A on the right rear leg compartment panel 56A of the right leg compartment. This will allow the rear leg compartment panels 56 and 56A to connect to one another, and the front leg compartment panels 55 and 55A to connect to one another, and the bottom edges to be fastened, creating one compartment, especially needed for use on a person dressed in a gown-type garment, and a seat with a crotch obstructionis not being used.

FIG. 2: See six small circles at the aperture 52 edges and bottom edges of the leg compartments 57 and 57A. These represent fasteners 66 such as snaps or hook and loop button fasteners. Other type fasteners can be used. I do not suggest buttons and hooks and eyes. These type fasteners can come loose after many washings and could pose a danger to a child. I also do not recommend hook and loop fastener strips, as these are noisy when pulled apart and can startle a person. I suggest that hook and loop fasteners of any kind should be fastened before laundering as they pick up lint which interfere with good adherence. I suggest that in the area where fasteners are to be attached that an additional strip of material be sewn onto flexible material 50 as a reinforcement for the fasteners. Install at least two fasteners on each set of inner segments to close inner segment 58A against inner segment 58C, and 58B against 58D, and one at the bottom of each leg compartment closing lower segments 50G against 501, and 50H against 50J. Do not place fasteners at the apex 58 nor too far up on the inner segments as a caretaker or user won't be able to reach the fasteners to fasten them.

FIG. 3: Baste and gather the circular edges remaining located at the bottom edge of the upper section of flexible material 50, and affix the gathered flexible material 50 at a point of approximately 90 degrees 60 on the left side of flexible material 50 and approximately 270 degrees 60A on the right side of flexible material 50 in a user's hip area. See FIG. 4. The fullness of the gathered material adequately covers a user's torso.

FIGS. 4 and 5: Rear and front views, respectively of first embodiment. The covering blanket is to be applied onto a person with leg compartments 57 and 57A unfastened, straddling a crotch obstruction if there is one. The rear leg compartment panels 56 and 56A are to be drawn behind the legs and fastened, wherein inner segment 58A of left front leg compartment panel 55 is fastened to inner segment 58C of left rear leg compartment panel 56, and inner segment 58B of right front leg compartment panel 55A is fastened to inner segment 58D of right rear leg compartment panel 56A, and bottoms of leg compartments 57 and 57A at lower segments 50G, H, I and J are fastened if desired.

Second Embodiment

FIG. 6: For the second embodiment, a wrap, additional flexible material in the longitudinal dimension for a user's head 70 is added to the first embodiment, and additional flexible material in the width 72 and 72A is added to the first embodiment. The circular cuts forming the rear leg compartment panels 56 and 56A are the same as in the first embodiment, starting at the same distance from the apex 58 as in the first embodiment. In the first embodiment inner segments 58C and 58D of the rear leg compartment panels 56 and 56A, were already existing as they were the edges of the flexible material 50. In this second embodiment, there is extra material 72 and 72A on the sides of areas known as inner segments 58C and 58D of the first embodiment, causing inner segments 58C and 58D to not be established. Inner segments 58C and 58D must be established. This is done by measuring from the aperture 52 along lower segment and outwardly to the left a distance half the desired width of the left leg compartment, establishing lower segment 50G. Continue measuring to the left establishing lower segment 50I which is the second half of the desired width of the left leg compartment. At this point cut upward a distance the length of the aperture to a point which will be your 180 degree mark 59, establishing inner segment 58C. Then do the same for the right leg compartment. Measure from the aperture 52 along lower segment outwardly to the right a distance half the desired width of the right leg compartment, establishing lower segment 50H. Continue measuring to the right establishing lower segment 503, which is the second half of the desired width of the right leg compartment. At this point cut upward a distance the length of the aperture, to a point which will be your 180 degree mark 59A, establishing inner segment 58D. Then proceed as in the first embodiment to create the leg compartment panels.

FIGS. 7 and 8: In this second embodiment, the lower sections of the additional material 72 and 72A are to be removed. To do this, measure from the bottom edge of material 72 and 72A upward a distance equal to the length of the aperture, and cut material 72 and 72A straight across.

FIGS. 9, 10 and 11: The lower edges of the side sections are then gathered and affixed at a user's hip as in the first embodiment, and this second embodiment can be used as a covering blanket in the same manner as in the first embodiment.

FIGS. 12 and 13: The second embodiment has a dual purpose. It can also be used as a wrap. A person should be placed onto the blanket, legs wrapped and fastened, and the extra material 70, 72 and 72A allows the head and torso to be wrapped.

Third Embodiment

FIG. 14: The third embodiment is similar to the second embodiment. The difference is that only a small piece of the additional material in the width 72 and 72A is removed instead of the entire lower section as in the second embodiment. The remaining material 72 and 72A that is not cut away are triangular pieces that will attach to the outside edges of the closed leg compartments, called wings 74 and 74A. To cut the material 72 and 72A properly to create the wings, start cutting from the outside bottom edge corners upward diagonally to the 180 degrees marks 59 and 59A which are the same points at which the circular cuts were started earlier. The diagonally cut edges being affixed to the lower outer segments at the sides of the leg compartments give gradual fullness from the user's feet to the user's lower torso area, eliminating excess cumbersome material in the area of a user's feet, while providing an appropriate amount of material to cover a user's lower torso.

FIG. 15: Gather and affix the circularly cut bottom edge of the upper sections in the same manner as in the first embodiment. Then place the diagonally cut edges, wings 74 and 74A against the outside edges 50K and 50L of the closed leg compartments 57 and 57A respectively and sew.

FIGS. 16 and 17: The blanket of this third embodiment can be used as a covering blanket, or FIGS. 18 and 19: as a wrap. The wings 74 and 74A afford a little more coverage for the lower torso area.

Fourth Embodiment

FIG. 20: The fourth embodiment is cut and gathered the same as the second embodiment.

FIGS. 21 and 22: This fourth embodiment is the same as the second embodiment except that it does not have additional material 70 for a user's head. Instead, it has a hood 76 that is shown detachable but could be made integral. This fourth embodiment can be used as a covering blanket.

FIGS. 23 and 24: This fourth embodiment has a dual purpose. It can also be used as a wrap.

Fifth Embodiment

FIGS. 25, 26, 27, 28: The fifth embodiment is the same as the third embodiment, except that it does not have additional material 70 for a user's head. Instead, it has a hood 76 that is shown detachable but could be made integral. This fifth embodiment also has wings 74 and 74A and can be used as a covering blanket, or FIGS. 29 and 30: as a wrap. The wings 74 and 74A afford a little more coverage for the lower torso area.

Sixth Embodiment

FIG. 31: While the first five embodiments can be made from one piece of material 50, and the gatherings at a user's hip area offer extra material where needed and a unique style, a sixth embodiment of this invention leaves the blanket flat. This sixth embodiment is constructed by cutting the rear leg compartment panels 56 and 56A from a separate piece of material 50 and then sewing the outside edges of the rear leg compartment panels 56 and 56A onto a piece of material 50. This embodiment can be a covering blanket only, or Seventh Embodiment FIGS. 32, 33, 34: a combination covering blanket and wrap, which is the seventh embodiment. The seventh embodiment is the same as the sixth embodiment except there is additional material 70 for a user's head for when FIGS. 35 and 36: used as a wrap.

Eighth Embodiment

FIG. 37: The eighth embodiment of this invention is the same as the sixth embodiment but adds a hood 76 either integral or attached, shown attached, FIGS. 38 and 39: and can be used as a covering blanket or FIGS. 40 and 41: as a wrap.

Ninth Embodiment

FIGS. 42 and 43: The ninth embodiment is a garment for an invalid or a handicapped person in a wheelchair. Less material 50 is needed for the torso. The garment shown is slacks and secures at the waistline. Privacy flaps 82 and 82A are sewn on to flexible material 50 to cover a user's upper buttocks area. The upper portion of the garment is to be wrapped around a user and ties 86 and 86A are attached to tie at the front waistline.

FIG. 43A: Embodiment 9 is shown. Upper section of material 50 above left rear leg compartment panel 56 is lifted, shows underwear 84 on a user's buttocks.

FIG. 43B: Embodiment 9 is shown. Left leg privacy panel 82 is shown sewn to flexible material 50 above left rear leg compartment panel 56.

Tenth through 15th Embodiments

FIG. 44 In embodiments 10 to 15 additional front leg compartment panels 68 and 68A, if not already inherent, are attached to inner segments 58C and 58D of rear leg compartment panels 56 and 56A. These second front leg compartment panels 68 and 68A wrap over and on top of the first applied front leg compartment panels 55 and 55A and fasten to flexible material 50 to hold these second front leg compartment panels 68 and 68A in place. Fasteners at inner segment 58A, 58B, 58C, 58D are optional 10th to 14th Embodiments These embodiments are of the same construction as embodiments 1 through 5, but further include the second set of front leg compartment panels 68 and 68A.

15th Embodiment

FIG. 45: Embodiment 15 is a garment made with the second set of front leg compartment panels 68 and 68A. Privacy flaps 82 and 82A are attached to front leg compartment panels 68 and 68A respectively. There are two sets of ties. The first set of ties 86 and 86A wrap the upper garment over the abdomen and around the upper buttocks. The second set of ties 88 and 88A wrap the privacy flaps around a user's lower buttocks area. The first set 86 and 86A is at the top corners of the garment. The second set 88 and 88A is at the top corners of the privacy flaps 82 and 82A. All ties wrap around the backside of a user and tie at the front waistline.

FIG. 46: Embodiment 15, additional front leg compartment panels 68 and 68A are in place. Upper section of flexible material 50 above left rear leg compartment panel is lifted, shows underwear 84 on a user's buttocks.

FIG. 47: Embodiment 15, left leg privacy panel 82 shown attached to second front leg compartment panel 68 of left leg compartment 57.

FIG. 48: From between inner segments 58A and 58C, view through 55 and 56 showing male 66A and female 66B fastening snaps engaged.

Summary, Ramifications and Scope

Summary

In different embodiments, this invention can be used as a covering blanket, wrap or garment. This invention as a covering blanket covers a user's torso and wraps a user's legs into leg compartments without a user nor a user's legs having to be lifted. This covering blanket can ideally be used on a young child seated in a seat, which seat has an obstruction between the child's legs in the crotch area. It is also ideal for use on an invalid or handicapped person seated in a wheelchair. As a wrap this invention is ideal for a small child, and can be used as a wrap for a larger person as well. As a garment for an invalid or handicapped person, this invention allows a person who has use of his arms to be able to dress and undress himself while seated in a wheelchair.

Ramifications and Scope

1. The cut from the apex at 180 degrees to a user's hip areas, approximately 90 degrees and approximately 270 degrees may be of a cut other than circular, and may culminate at 90 degrees, more or less, and may culminate at 270 degrees, more or less as desired.

2. In the wraps of embodiments 4, 5 and 8 the hood can be detached and replaced with a bib.

3. In the wraps of embodiments 2,3 and 7 a fastener can be placed in the center of the top edge of the blanket, that when fastened form a pointed hood.

4. Booties, integral or removable, of different shapes can be added.

5. Fasteners can be placed on the bottom edges of leg compartments.

6. Additional material 50 can be added to expose or conceal the crotch area.

7. The invention can be made in various colors, shapes and sizes appropriate for different ages of persons, from infancy to adult, and for tucking in.

8. The invention can be made having fasteners placed at various locations to allow the user to adjust the blanket to accomodate different sized persons.

9. The outside edges of the invention can be serged, or trimmed with binding in different materials and may be gathered or may have elastic.

10. The aperture could be placed off-center to better accommodate placement of blanket around an obstruction.

11. The aperture could be provided with alternative configurations to accommodate obstructions having different shapes.

12. The embodiments can be made to be disposable, and fasteners can be of the types used on disposable diapers.

13. Fastening elements can be hook and loop fastening buttons or strips. However, strips make noise that could startle a person when unfastened, and therefore are not suggested.

14. Inner segments may be moved to another area of the leg compartments including but not limited to the outside edges of the leg compartments, and fastening elements may be placed at other areas of the leg compartment.

15. In embodiments 10 to 15 fasteners at the inner segments are optional.

16. Other types of fasteners that can be used are, but are not limited to, buttons, and button holes, zippers, hook and eye fasteners, and straps and buckles.

17. Visual markings in the forms such as appliques, patches, buttons may be added to mark the underlying fasteners to aid in finding the fasteners quickly.

18. The upper portion of covering can be of different sizes and different shapes, where less material is desired in the torso area, eliminating excess material to interfere with an upper garment, food or whatever else.

19. A securing element such as laces, hook and loop strips, straps or other securing element can be attached to the blanket of this invention to secure the blanket (a) to itself when used as a wrap, (b) to the seating structure when used as a covering, (c) to a person's clothing when used as a covering, (d) against a person's chest by way of a securing element such as a strap or lace placed behind a person's neck,.

(e) to a pacifier, toy, security blanket or the like.

20. Second front leg compartment panels 68 and 68A may be attached to inner segments 58A and 58B and wrap around the back of the legs twice instead of the front of the legs twice.

21. In this invention made as a garment, flexible material 50 covering a user's torso can be secured with various types of fasteners or ties to secure the material in place. The garment may be made as a jumper, full garment covering the entire torso, or as part of a multi-piece outfit, similar to garments and outfits on the market for non-invalids and non-handicapped pesons.

22. In this invention made as a garment, pockets may be added.

23. As a garment, the invention can be made distinguishably for male or female or unisex. Male garments could have a front fly with fasteners as one would expect to see on male garments.

24. As a garment, the invention may be made comprising one or more additional garments being integral, attached or separate.

25. Any embodiment of my invention can be made from a wide variety of materials and can be of double-faced fabric, two layers back to back, so when flexible material 50 folds over, the pattern side is seen as opposed to the wrong side being seen. Flexible material 50 may consist of more than one piece of material joined together, as in a patch quilt, or in the producing of a special pattern. Any material known to be suitable for forming blankets or garments could be used as desired or in combinations thereof. Just a few examples of suitable materials include natural and synthetic fabrics or sheet goods such as wool, cotton, leather, foil, polyethylene, polyurethane, polyamide, polymide latex rubber vinyl copolymer, styrene-butadiene containing polymer, polyester paper, combinations of these materials and the like. My invention may also be formed so that one or both surfaces is food and/or water repellent to facilitate easy clean-up.

Other embodiments of this invention will be apparent to those skilled in the art upon consideration of this specification or from practice of the invention disclosed herein. Various omissions, modifications, and changes to the principles and embodiments described herein may be made by one skilled in the art without departing from the true scope and spirit of the invention which is indicated by the following claims:

I claim:

1. A bifurcated wrap-around covering comprising:

flexible material of a size that is appropriate for a seated user, said flexible material including a front side, a back side, and top and bottom edges;

said flexible material forming a torso covering and leg compartments;

said leg compartments including a left leg compartment and a right leg compartment, wherein each compartment includes a front section, a back section, a top edge, and a bottom edge;

at least one said leg compartment having fastening means permanently affixed to said flexible material;

said wrap-around covering further comprising an aperture and an apex at the upper end of the aperture, said aperture and said apex separating the left leg compartment and the right leg compartment;

said top edges of said back sections of said leg compartments extending from the area of said apex to cover the entire backsides of a user's legs; and said top edge of said left leg compartment back section extending outwardly and upwardly to the left to the outside edge of said left leg compartment and culminating generally at the left hip area of a user; and said top edge of said right leg compartment back section extending outwardly and upwardly to the right to the outside edge of the right leg compartment and culminating generally at the right hip area of a user;

wherein said top edges of the said left and right leg compartment back sections surround and expose the buttocks of a user thereby facilitating use of said wrap-around covering on a seated user; and wherein said top edges of said left and right leg compartment back sections extend outwardly and upwardly to cover the upper thigh and hip areas of a user; and wherein said top edges of said left and right leg compartment back sections extend from the area of said apex to cover the entire back sides of the legs of a user.

2. The wrap-around covering of claim 1 wherein said torso covering has a securing means to secure said flexible material against itself or to the clothing of a user.

3. The wrap-around covering of claim 2, wherein additional flexible material is added to said flexible material to form hanging flaps, said flaps creating privacy to cover and conceal the buttocks of a user when a user is removed from a seating structure.

4. The wrap-around covering of claim 1, further comprising additional material added to the length and the width of the flexible material to cover the head and upper torso of a user;

said additional material in the width extending from the left outside and bottom edges as a triangular section of diagonally cut material to the left of the left side of said left leg compartment;

said additional material in the width extending from the right outside and bottom edges as a triangular section of diagonally cut material to the right of the right side of said right leg compartment; and said diagonally cut material being attached to respective lower outer segments of said leg compartments;

wherein the diagonally cut edges are affixed to the lower outer segments at the sides of the leg compartments thereby giving gradual fullness to the flexible material from the bottom edge to the top edge, and thereby eliminating excess material in the area of the feet of a user while simultaneously providing an adequate amount of material to cover the lower torso of a user.

5. The wrap-around covering of claim 1, wherein the bottom edges of said torso covering are basted, gathered, sewn, and affixed to itself approximately at the hip areas of a user on each side, respectively, whereby the fullness of the gathered material is adequate to cover the torso of a user.

6. A bifurcated wrap-around covering comprising:

flexible material of a size that is appropriate for a seated user, said flexible material including a front side, a back side, and top and bottom edges;

said flexible material forming a torso covering and leg compartments;

said leg compartments including a left leg compartment and a right leg compartment, wherein each compartment includes a front section, a back section, a top edge, and a bottom edge;

said wrap-around covering further comprising an aperture and an apex at the upper end of the aperture, said aperture and said apex separating the left leg compartment and the right leg compartment;

said top edges of said back sections of said leg compartments extending from the area of said apex thereby surrounding and exposing the buttocks of a user to facilitate use of said wrap-around covering on a seated user; and said top edge of said left leg compartment back section extending outwardly and upwardly to the left to the outside edge of said left leg compartment and culminating generally at the left hip area of a user; and said top edge of said right leg compartment back section extending outwardly and upwardly to the right to the outside edge of the right leg compartment and culminating generally at the right hip area of user.

7. A method for making a covering comprising a rectangular piece of flexible material in a predetermined size suitable for an infant child, the method comprising the steps of:

establishing a center line between the left and right edges of said flexible material;

measuring from an upper segment of said material to a lower segment of said material a distance approximately two-thirds to one-half the distance on said established center line, and marking and designating this point as an apex;

starting from said center line at said lower segment, cutting an aperture upwardly to said apex a distance appropriate in separating two compartments for the legs of the user;

from the right and left lower segments of said material, measuring upwardly along the outer edges a distance equal to the length of said aperture to points on the outer edges, respectively a left point and a right point;

from the left point on the left side of said material, cutting inwardly and upwardly a distance halfway to said apex to a point culminating approximately at the left hip area of a user, thereby establishing the top edge of a left rear leg compartment panel; and from the right point on the right side of said material, cutting inwardly and upwardly a distance halfway to said apex to a point culminating approximately at the right hip area of a user, thereby establishing the top edge of a right rear leg compartment panel;

finishing all the edges;

folding over the material under the cut that extends from the left side, wherein the left edge of the material is designated as a third inner segment and is flopped over wherein said third inner segment lies on top of a first inner segment, both segments outlining the left side of said aperture forming the left leg compartment;

folding over the material under the cut that extends from the right side, wherein the right edge of the material is designated as a fourth inner segment and is flopped over wherein said fourth inner segment lies on top of a second inner segment, both segments outlining the right side of said aperture forming the right leg compartment;

permanently adding temporary fastening means along the inner segments to engage and disengage one to the other; and basting and gathering the cut edges remaining at the bottom of the left and right upper sections of flexible material, and sewing and affixing the gathered material to itself approximately at a user's respective hip areas, wherein the gathered material is for covering the torso of a user;

wherein said top edges of said rear leg compartment panels extend outwardly and upwardly from the area of said apex and terminate at the areas of the hips of a user; and wherein the hips, the upper thighs, and the entire back sides of the legs of a user are covered; and wherein said wrap-around covering surrounds and exposes the buttocks of a user thereby facilitating placement on a seated user even when the seating structure has a vertical obstruction in the area of a user's crotch.

8. A bifurcated wrap-around covering comprising:

flexible material of a size that is appropriate for a seated user, said flexible material including a front side, a back side, and top and bottom edges;

said flexible material forming a torso covering and a set of leg compartments;

said set of leg compartments including a left leg compartment and a right leg compartment, wherein each said compartment includes a front section, a back section, a top edge, and a bottom edge;

said wrap-around covering further comprising an aperture and an apex at the upper end of the aperture, said aperture and said apex separating said left leg compartment and said right leg compartment; and said top edges of said back sections of said leg compartments extending from the area of said apex thereby surrounding and exposing the buttocks of a user to facilitate use of said wrap-around covering on a seated user, wherein the entire back sides of the legs of a user are covered; and further comprising a set of leg compartment panels adapted to overly said set of leg compartments.

9. The wrap-around covering of claim 8, wherein said top edge of said left leg compartment back section extends outwardly and upwardly to the left to the outside edge of said left leg compartment and culminates generally at the left hip area of a user; and said top edge of said right leg compartment back section extends outwardly and upwardly to the right to the outside edge of the right leg compartment and culminates generally at the right hip area of a user.

10. The wrap-around covering of claim 9, wherein said torso covering has a securing means to secure said flexible material against itself or to the clothing of a user.

11. The wrap-around covering of claim 10, wherein additional flexible material is added to said flexible material to form hanging flaps, said flaps creating privacy to cover and conceal the buttocks of a user when a user is removed from a seating structure.

12. The wrap-around covering of claim 8, wherein said second set of leg compartment panels include fastening means.

13. A method for making a covering comprising a rectangular piece of flexible material in a predetermined size suitable for an infant child, the method comprising the steps of:

establishing a center line between the left and right edges of said flexible material;

measuring from an upper segment of said material to a lower segment of said material a distance approximately two-thirds to one-half the distance on said established center line, and marking and designating this point as an apex;

starting from said center line at said lower segment, cutting an aperture upwardly to said apex a distance appropriate in separating two compartments for the legs of a user, and thereby establishing a first set of left and right front leg compartment panels;

from the right and left lower segments of said material, measuring upwardly along the outer edges a distance equal to the length of said aperture to points on the outer edges;

from the point on the left side of said material, cutting inwardly and upwardly a distance two-thirds to said apex to a point culminating approximately at the left hip area of a user, thereby establishing a second left front leg compartment panel and a left rear leg compartment panel, the cut itself establishing the top edge of the second left front leg compartment panel and the top edge of the left rear leg compartment panel; and from the point on the right side of said material, cutting inwardly and upwardly a distance two-thirds to said apex to a point culminating approximately at the right hip area of a user, thereby establishing a second right front leg compartment panel and a right rear leg compartment panel, the cut itself establishing the top edge of the second right front leg compartment panel and the top edge of the right rear leg compartment panel;

folding over the material on the left side under the cut to create a vertical fold beneath the left hip area of a user, thereby establishing an outside edge of the left leg compartment and placing the left rear leg compartment panel on top of the first left front leg compartment panel;

folding over the material on the right side under the cut to create a vertical fold beneath the right hip area of a user, thereby establishing an outside edge of the right leg compartment and placing the right rear leg compartment panel on top of the first right front leg compartment panel;

bringing a second set of left and right front leg compartment panels from the backside of the leg compartments through the aperture;

placing the second set of front leg compartment panels over the front of the first set of leg compartment panels on each side, respectively; and securing the second set of leg compartment panels by fastening means;

wherein said wrap-around covering surrounds and exposes the buttocks of a user thereby facilitating placement on a seated user even when the seating structure has a vertical obstruction in the area of a user's crotch.

* * * * *